US009507293B2

(12) United States Patent
Fujiwara

(10) Patent No.: US 9,507,293 B2
(45) Date of Patent: Nov. 29, 2016

(54) IMAGE FORMING APPARATUS AND IMAGE CARRIER UNIT

(71) Applicant: Oki Data Corporation, Tokyo (JP)

(72) Inventor: Yasuhiro Fujiwara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/947,724

(22) Filed: Nov. 20, 2015

(65) Prior Publication Data

US 2016/0252850 A1 Sep. 1, 2016

(30) Foreign Application Priority Data

Feb. 26, 2015 (JP) ..... 2015-036199

(51) Int. Cl.
*G03G 15/095* (2006.01)

(52) U.S. Cl.
CPC ..... *G03G 15/095* (2013.01)

(58) Field of Classification Search
CPC ..... G03G 15/095; G03G 15/161; G03G 15/168; G03G 21/10; G03G 2215/1647; G03G 2215/1661
See application file for complete search history.

(56) References Cited

U.S. PATENT DOCUMENTS

2005/0180773 A1* 8/2005 Morimoto ..... G03G 15/168 399/101
2007/0071525 A1* 3/2007 Yoshino ..... G03G 21/0011 399/346
2012/0219315 A1* 8/2012 Suzuki ..... G03G 15/161 399/101

FOREIGN PATENT DOCUMENTS

JP 2009-008904 A 1/2009

* cited by examiner

*Primary Examiner* — Sandra Brase
(74) *Attorney, Agent, or Firm* — Muncy, Geissler, Olds & Lowe, P.C.

(57) ABSTRACT

An image forming apparatus includes an image carrier that holds a developer image on a surface of the image carrier, a cleaning member that removes a remaining developer that remains on the surface of the image carrier after the developer image is transferred to a transfer target by contacting the surface of the image carrier, an accumulation part that accumulates the remaining developer removed by the cleaning member, a supply member that supplies the remaining developer accumulated in the accumulation part to the surface of the image carrier, a carrying mechanism that carries an excess developer toward an outside, the excess developer being defined as developer overflowing from the accumulation part.

26 Claims, 24 Drawing Sheets

Image Forming Part
Separation Roller Pair
Carrying Roller Pairs
Carrying Roller Pairs
1
11W
11Y
11M
11C
11K
110
114
113
117
112
111
116
133
132b
131
120
121B
123B
123A
122B
122A
120
121A
124a
124b
124c
13
14
15
10
16a
16b
16c
17
18
132a
136
135
134
d1
d2

IMAGE FORMING APPARATUS AND IMAGE CARRIER UNIT

CROSS REFERENCE

The present application is related to, claims priority from and incorporates by reference Japanese Patent Application No. 2015-036199, filed on Feb. 26, 2015.

TECHNICAL FIELD

The present invention relates to an image forming apparatus for forming an image using an electrographic system and an image carrier unit applied to such an image forming apparatus.

BACKGROUND

In an image forming apparatus using an electrographic system, a toner image formed (transferred) directly or indirectly from an image forming part onto a recording medium such as a sheet, etc., is fused on the medium in a fuser device (fuser). In this way, an image is formed using an electrographic system.

In such an image forming apparatus, generally, to remove a toner remaining (remaining toner) on a transfer belt, etc., (image carrier) to perform cleaning, a cleaning blade (cleaning member) is provided. Further, for example, Patent Document 1 proposes to suppress abrasion and "turn-up" in a cleaning blade by accumulating such remaining toner to use them as a lubricant agent.

RELATED ART

JP Patent Application Publication 2009-8904

By the way, in general, in an image forming apparatus, since it is desired to prolong a life of a cleaning member, a proposal for a method to realize the prolongation of the life of the cleaning member is desired.

The present invention was made in view of the aforementioned problems, and aims to provide an image forming apparatus and an image carrier unit capable of prolonging a life of a cleaning member.

SUMMARY

An image forming apparatus disclosed in the application includes an image carrier that holds a developer image on a surface of the image carrier, a cleaning member that removes a remaining developer that remains on the surface of the image carrier after the developer image is transferred to a transfer target by contacting the surface of the image carrier, an accumulation part that accumulates the remaining developer removed by the cleaning member, a supply member that supplies the remaining developer accumulated in the accumulation part to the surface of the image carrier, a carrying mechanism that carries an excess developer toward an outside, the excess developer being defined as developer overflowing from the accumulation part.

An image carrier unit includes an image carrier that carries a developer image on a surface of the image carrier, a cleaning member that removes a remaining developer that remains on the surface of the image carrier after the developer image is transferred to a transfer target by contacting the surface of the image carrier, an accumulation part that accumulates the remaining developer removed by the cleaning member, a supply member that supplies the remaining developer accumulated in the accumulation part to the surface of the image carrier, and a carrying mechanism that carries an excess developer toward an outside, the excess developer being defined as developer overflowing from the accumulation part.

According to the image forming apparatus and the image carrier unit of the present invention, it is possible to prolong a life of a cleaning member.

BRIEF DESCRIPTIONS OF THE DRAWINGS

DETAILED DESCRIPTIONS OF PREFERRED EMBODIMENT(S)

Hereinafter, an embodiment of the present invention will be explained in detail with reference to the attached drawings.

1. Embodiment (an application example of an intermediate transfer method to an image forming apparatus)
2. Modified Examples Modified Example 1 (an example in which a spiral-shaped ditch part is provided in the toner supply roller)

Modified Example 2 (an example which is structured so that the toner supply roller and the carrying spiral are symmetrical)

Modified Example 3 (an example in which a photosensitive drum also functions as a supply mechanism of a dummy toner)

Modified Example 4 (an example in which a cleaning mechanism is also provided in the image forming part in the intermediate transfer method)

Modified Example 5 (an application example of a direct transfer method to an image forming apparatus)

3. Other Modified Examples

<1. Embodiment>

[Schematic Configuration]

Figure 1:
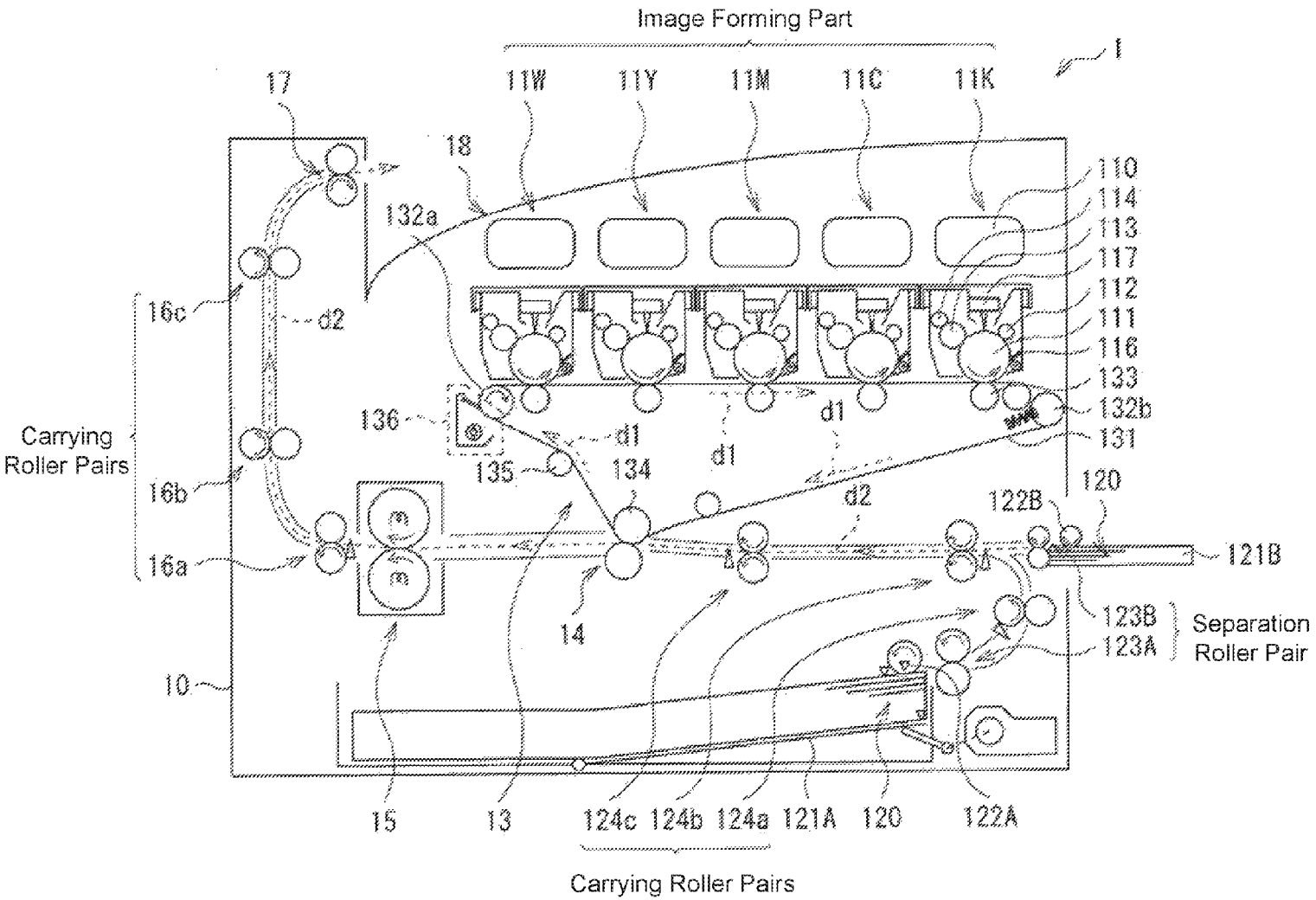
FIG. 1 is a schematic view showing one example of a schematic configuration of an image forming apparatus according to an embodiment of the present invention.

FIG. 1 schematically shows an example of a schematic configuration of an image forming apparatus (image forming apparatus 1) according to an embodiment of the present invention. The image forming apparatus 1 functions as a printer (a color printer in this example) for forming an image (a color image in this example) on a recording medium 120 such as, for example, a normal sheet, etc., using an electrographic system. Further, as will be explained later, the image forming apparatus 1 is a so-called intermediate transfer system image forming apparatus in which a toner image is transferred to a recording medium 120 via an intermediate transfer belt unit 13 to be explained later.

The image forming apparatus 1, as shown in FIG. 1, is equipped with five image forming parts 11W, 11Y, 11M, 11C, and 11K, sheet trays (sheet feeding trays) 121A and 121B, pickup rollers 122 A and 122B, and carrying roller pairs 124*a*, 124*b*, and 124*c*. Also, the image forming apparatus 1 is equipped with an intermediate transfer belt unit 13, a secondary transfer roller 14, a fuser (fuser device) 15, carrying roller pairs 16*a*, 16*b* and 16*c*, an ejection roller pair 17, and a mounting part 18.

In addition, each of these members, as shown in FIG. 1, is accommodated in a predetermined housing 10 having an openable and closable upper cover, etc., (not illustrated) with the exception of a portion of a sheet tray 121B, a mounting part 18, etc. Further, each of the image forming parts 11W, 11Y, 11M, 11C, and 11K is integrally constituted and removably attached to the image forming apparatus 1.

The sheet tray 121A and 121B are members for accommodating recording mediums 120 in a stacked state. In the example as shown in FIG. 1, the sheet tray 121A is a built-in tray that is removably attached to the lower part in the image forming apparatus 1, and the sheet tray 121B is an external tray that is removably attached to the side surface of the housing 10. Further, the recording medium 120 corresponds to one specific example of the "transfer target" of the present invention.

The pickup roller 122A is a feeding member (sheet feeding mechanism) in which, by operating in conjunction with the separation roller pair 123A, a recording medium 120 accommodated in the sheet tray 121A is separated one by one from the uppermost part and removed, then fed toward the carrying roller pair 124*a* and 124*b*. Similarly, the pickup roller 122B is a feeding member in which, by operating in conjunction with the separation roller pair 123B, separates and removes a recording medium 120 accommodated in the sheet tray 121B one by one from the uppermost part, then feeds it toward the carrying roller pair 124*b*.

Each of the carrying roller pairs 124*a*, 124*b*, and 124*c* is a member that sandwiches and carries the recording medium 120 fed from the separation roller pair 123A or the separation roller pair 123B, and corrects the slant of the recording medium 120 to carry it to the secondary transfer roller 14 side. In other words, these carrying roller pairs 124*a*, 124*b*, and 124*c* carry the recording medium 120 along a carrying path (carrying direction) d2. Further, as shown in FIG. 1, the carrying path d2 is an S-shaped path as a whole in this example. The above carrying path d2 is defined as sheet carrying paths.

(Image Forming Parts 11W, 11Y, 11M, 11C, 11K)

The image forming parts 11W, 11Y, 11M, 11C, and 11K, as shown in FIG. 1, are aligned and arranged along the carrying direction (carrying path) d1 of an intermediate transfer belt 131 which will be explained later. Specifically, the image forming parts are arranged in the order of 11W, 11Y, 11M, 11C, and 11K along this carrying direction d1 (from the upstream side to the downstream side).

These image forming parts 11W, 11Y, 11M, 11C, and 11K are for forming an image (toner image) on the intermediate transfer belt 131 which will be explained later using toners (developers) different in color from each other. Specifically, the image forming part 11W forms a white toner image using a white (W: White) toner, the image forming part 11Y forms a yellow toner image using a yellow (Y: yellow) toner, and the image forming part 11M forms a toner image of a magenta color using a magenta (M: Magenta) toner. Similarly, the image forming part 11C forms a cyan colored toner image using a cyan (C: Cyan) toner and the image forming part 11K forms a black toner image using a black (K: black) toner.

As a coloring agent used in the yellow toner, the magenta toner, the cyan toner, and the black toner, dyes, pigments, etc., can be used on its own or by combining them. Specifically, as such a coloring agent, for example, carbon black, iron oxide, permanent brown FG, pigment green B, pigment blue 15:3, solvent blue 35, solvent red 49, solvent red 146, quinacridone, carmine 6B, naphthol, Disazo yellow, isoindolin, etc., can be used.

On the other hand, as a coloring agent for the white (white colored) toner, for example, pigments having a large specific gravity such as metal oxides (titanium oxide, zinc oxide, etc.) that are generally used as white pigments can be exemplified. Such a white pigment, for example, can be subjected to a surface process or a plurality of types can be used in combination. Further, in the coloring agent for the white toner, the content amount of the white pigment is larger in consideration of the coloring power and the covering power.

Here, the image forming parts 11W, 11Y, 11M, 11C, and 11K have the same configuration except that they form toner images (developer images) using toners different in color from each other as explained above. Therefore, hereinafter, the image forming part 11K among them is used as a representative in the explanation.

As shown in FIG. 1, the image forming part 11K includes a toner cartridge 110 (developer container), a photosensitive drum 111 (image carrier), a charge roller 112 (charge member), a development roller 113 (developer carrier), a supply roller 114 (developer supply member), a cleaning blade 116 (cleaning member) and an exposure head 117 (exposure device).

The toner cartridge 110 is a container in which the aforementioned toner of each color is accommodated. That is, in this example of the image forming part 11K, a black toner is accommodated in the toner cartridge 110. Similarly, a white toner is accommodated in the toner cartridge 110 in the image forming part 11W, and a yellow toner is accommodated in the toner cartridge 110 in the image forming part 11Y. Further, a magenta toner is accommodated in the toner cartridge 110 in the image forming part 11M, and a cyan toner is accommodated in the toner cartridge 110 in the image forming part 11C.

The photosensitive drum 111 is a member for carrying an electrostatic latent image to the surface (surface layer portion) and is constituted using a photosensitive body (for example, an organic photosensitive body). Specifically, the photosensitive drum 111 is provided with a conductive supporting body and a photoconductive layer covering its outer periphery (surface). The conductive supporting body is constituted by, e.g., a metal pipe made of aluminum. The photoconductive layer, for example, has a structure in which a charge generation layer and a charge transportation layer are laminated in that order. In addition, such a photosensitive drum 111 is configured to rotate at a predetermined circumferential speed as shown with an arrow in FIG. 1, for example.

The charge roller 112 is a member for charging the surface (surface layer portion) of the photosensitive drum 111 and is arranged so as to come into contact with the surface (circumferential surface) of the photosensitive drum 111. The charge roller 112 is provided with, for example, a metal shaft and a semiconductive rubber layer (e.g., a semiconductive epichlorohydrin layer) covering the outer periphery (surface) of the metal shaft. In addition, such a charge roller 112, for example, is configured to rotate in a direction opposite to a rotational direction of the photosensitive drum 111.

The development roller 113 is a member for carrying the toner for developing an electrostatic latent image on a surface, and is arranged so as to come into contact with the surface (circumferential surface) of the photosensitive drum 111. The development roller 113 is provided with, for example, a metal shaft and a semiconductive urethane rubber layer covering the outer periphery (surface) of the metal shaft. In addition, such a development roller 113, for example, is configured to rotate in a direction opposite to a rotational direction of the photosensitive drum 111 at a predetermined circumferential speed.

The supply roller 114 is a member for supplying the toner accommodated in the toner cartridge 110 to the development roller 113, and is arranged so as to come into contact with the surface (peripheral surface) of the development roller 113. The supply roller 114 is provided with, for example, a metal shaft and a foaming silicone rubber layer covering the outer periphery (surface) of the metal shaft. In addition, such a supply roller 114, for example, is configured to rotate in the same direction as a rotational direction of the development roller 113, for example.

The cleaning blade 116 is a member for scraping off and removing (cleaning) the toner that remains on the surface (surface layer portion) of the photosensitive drum 111. The cleaning blade 116 is arranged so as to come into counter contact (direct contact) with the surface of the photosensitive drum 111 (protruding in a direction opposite to the rotational direction of the photosensitive drum 111). Such a cleaning blade 116, for example, is constituted by an elastic body such as a polyurethane rubber, etc.

The exposure head 117 is a device for forming an electrostatic latent image on the surface (surface layer portion) of the photosensitive drum 111 by irradiating irradiation light on the surface of the photosensitive drum 111 and exposing it. The exposure head 117 is supported by an upper cover (not illustrated) in the housing 10. The exposure head 117, for example, is constituted so as to include a plurality of light sources that emit light and a lens array for forming an image on the surface of the photosensitive drum 111 using the irradiation light. Further, for each of the light sources, for example, a light emitting diode (LED: Light Emitting Diode), a laser element, etc., can be exemplified.

(Intermediate Transfer Belt Unit 13)

The intermediate transfer belt unit 13, as shown in FIG. 1, is a belt unit to which the toner image of each color formed by each of the image forming parts 11W, 11Y, 11M, 11C, and 11K is primarily transferred (intermediately transferred). Further, the toner image of each color primarily transferred in such a way is secondarily transferred on a recording medium 120 carried on a carrying path d2 from the intermediate transfer belt unit 13 as shown in FIG. 1. The details will be described later. In addition, each of the members of such an intermediate transfer belt unit 13 to be explained below is integrally formed (unitized). Further, the intermediate transfer belt unit 13 corresponds to one specific example of the "image carrier unit" of the present invention.

Figure 2:
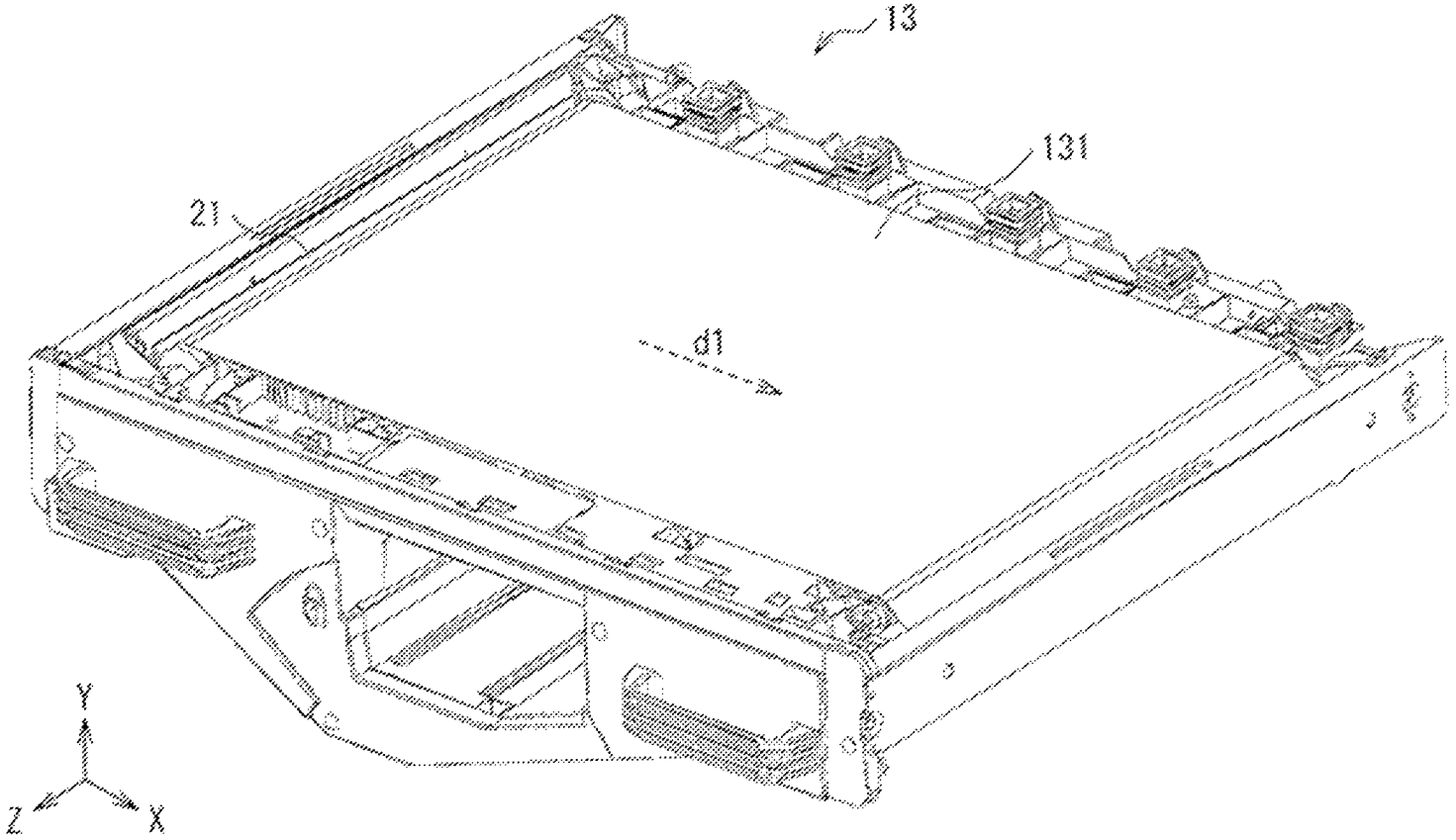
FIG. 2 is a perspective view showing an example of an outer appearance configuration of an intermediate transfer belt unit shown in FIG. 1.

Here, FIG. 2 shows a perspective view showing an example of the outer appearance configuration of the intermediate transfer belt unit 13. Further, FIG. 3 shows an example of the cross-sectional configuration (example of X-Y cross-sectional configuration) of the intermediate transfer belt unit 13 shown in FIG. 2.

Figure 3:
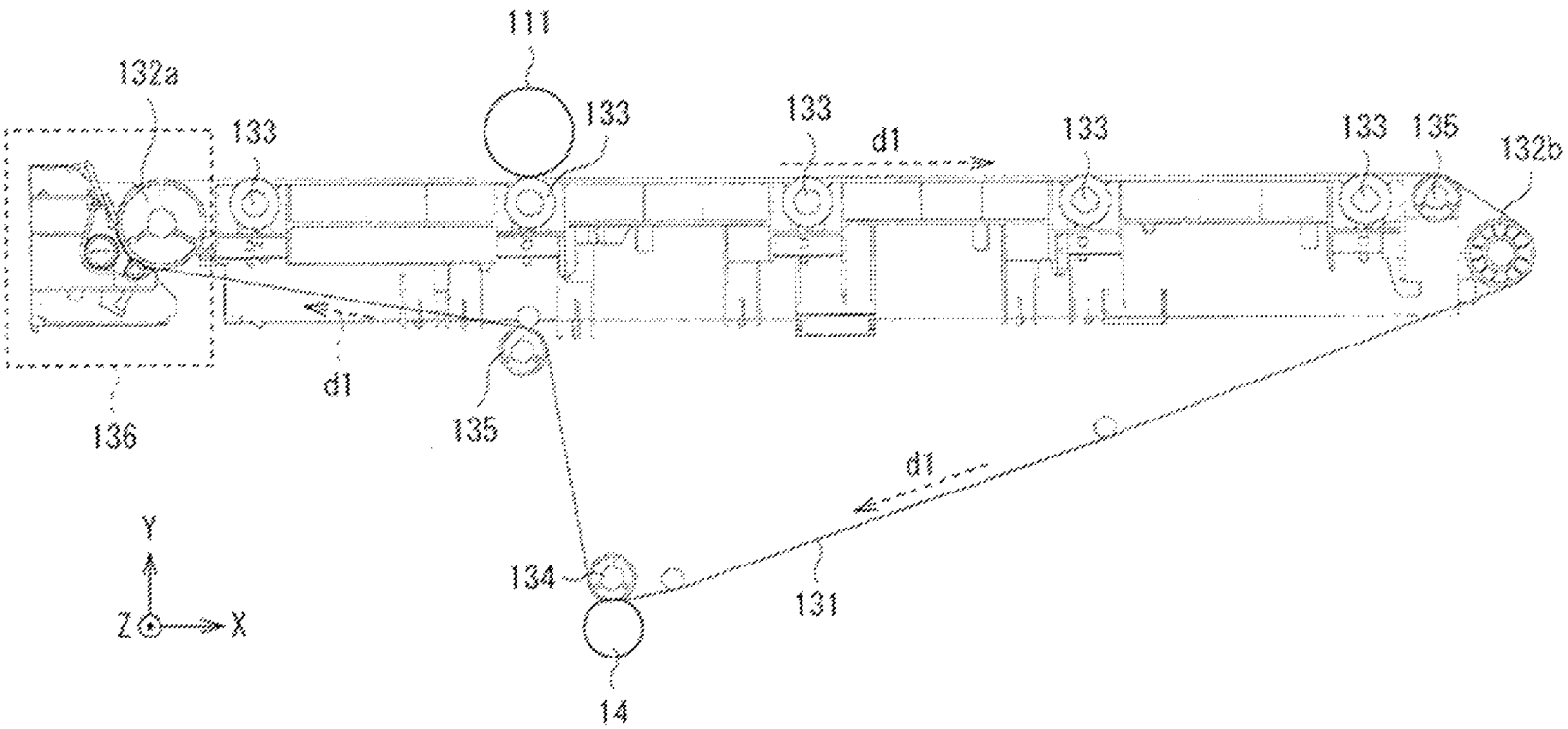
FIG. 3 is a view showing an example of a cross-sectional configuration of the intermediate transfer belt unit shown in FIG. 2.

As shown in FIG. 1 to FIG. 3, the intermediate transfer belt unit 13 is provided with an intermediate transfer belt 131, a drive roller 132*a*, an idler roller 132*b*, primary transfer rollers 133, a secondary transfer opposing roller 134, carrying rollers 135, and a cleaning mechanism 136.

The intermediate transfer belt 131, as explained above, is a belt in which the toner image of each color formed by each of the image forming parts 11W, 11Y, 11M, 11C, and 11K is primarily transferred on its surface. In other words, on the surface of the intermediate transfer belt 131, such toner image of each color is configured to be temporarily carried. The intermediate transfer belt 131, as shown in FIG. 1 and FIG. 3, is suspended by the drive roller 132*a*, the idler roller 132*b*, and the secondary transfer opposing roller 134. Further, the intermediate transfer belt 131 is configured to be carried in a manner as to rotate and move along the carrying direction d1 as shown in FIG. 1 by the drive roller 132*a*, the idler roller 132*b*, and the carrying rollers 135. The toner image of each color primarily transferred on the surface of the intermediate transfer belt 131 in such a manner is secondarily transferred on the recording medium 120 as a transfer target as it will be explained in detail below. Further, the intermediate transfer belt 131 corresponds to one specific example of the "image carrier" of the present invention.

The drive roller (driving roller) 132*a* is connected to an unillustrated motor, and by being rotated and riven by the motor, it is configured to rotationally move (perform a rotational movement of) the intermediate transfer belt 131. The idler roller (driven roller) 132*b* is configured to suspend the intermediate transfer belt 131 by applying a tensile force to the intermediate transfer belt 131 using a spring.

The primary transfer rollers 133 are each a member for electrostatically transferring (primarily transferring) the toner image of each color formed in each of the image forming parts 11W, 11Y, 11M, 11C, and 11K on the intermediate transfer belt 131. The primary transfer rollers 133, as shown in FIG. 1 and FIG. 3, are arranged via the intermediate transfer belt 131 so as to face the photosensitive drum 111 in each of the image forming parts 11W, 11Y, 11M, 11C, and 11K. In addition, such primary transfer rollers 133 are, for example, each constituted by a foaming semiconductive elastic rubber material.

The secondary transfer opposing roller 134 is arranged so as to face the later described secondary transfer roller 14 as shown in FIG. 1 and FIG. 3, and is a member for secondarily transferring the toner image of each color primarily transferred on the intermediate transfer belt 131 along with the secondary transfer roller 14 on the recording medium 120.

The carrying rollers 135, as described above, are members for carrying the intermediate transfer belt 131 in a manner as to rotate and move the intermediate transfer belt 131.

The cleaning mechanism 136, as shown in FIG. 1 and FIG. 3, is arranged at a position in which it faces the drive roller 132*a* via the intermediate transfer belt 131. The cleaning mechanism 136 is a mechanism for removing and cleaning (clearing) the toner remaining on the surface of the intermediate transfer belt 131 (remaining toner) from the surface after the toner image of each color is secondarily transferred to the recording medium 120.

Figure 4A:
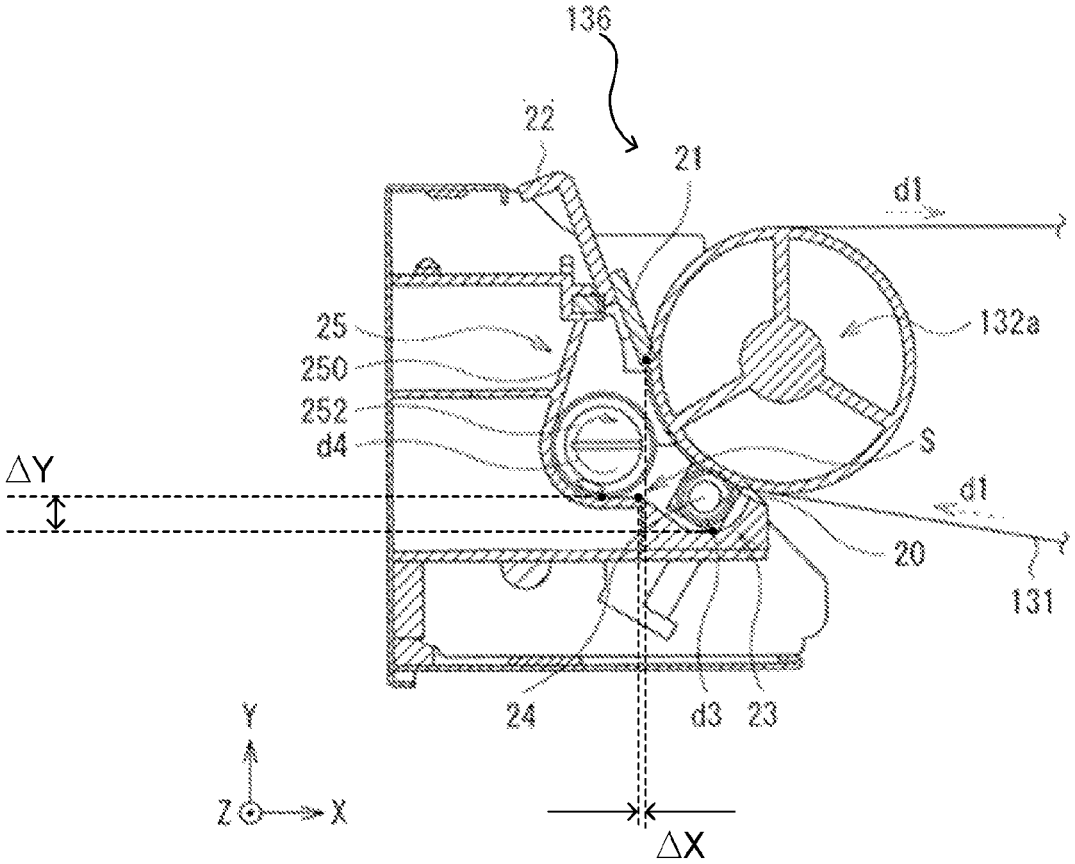
FIG. 4A is a cross-sectional view showing an example of a detailed configuration of a cleaning mechanism shown in FIG. 3.
Figure 5:
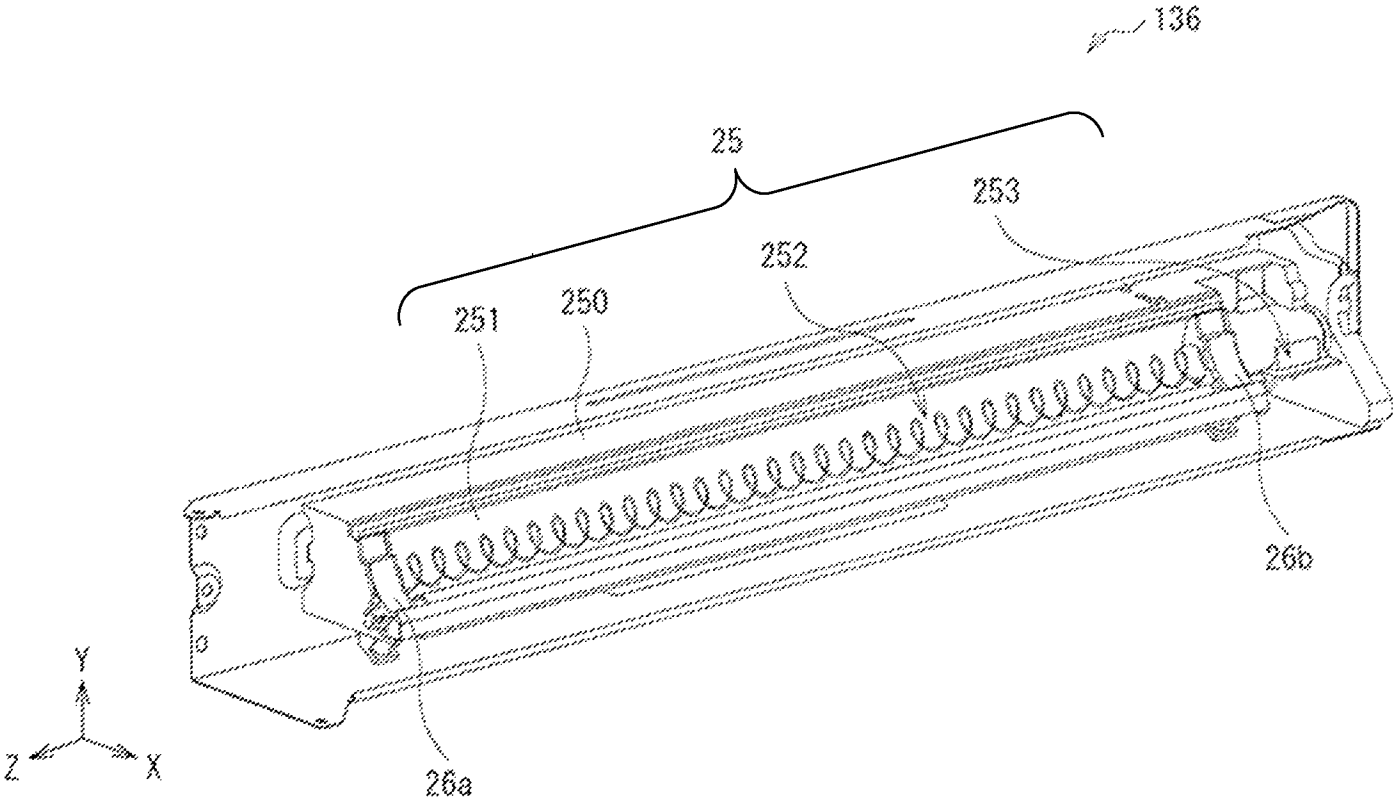
FIG. 5 is a perspective view showing a cleaning mechanism shown in FIG. 4A in which a portion is pulled out.
Figure 6:
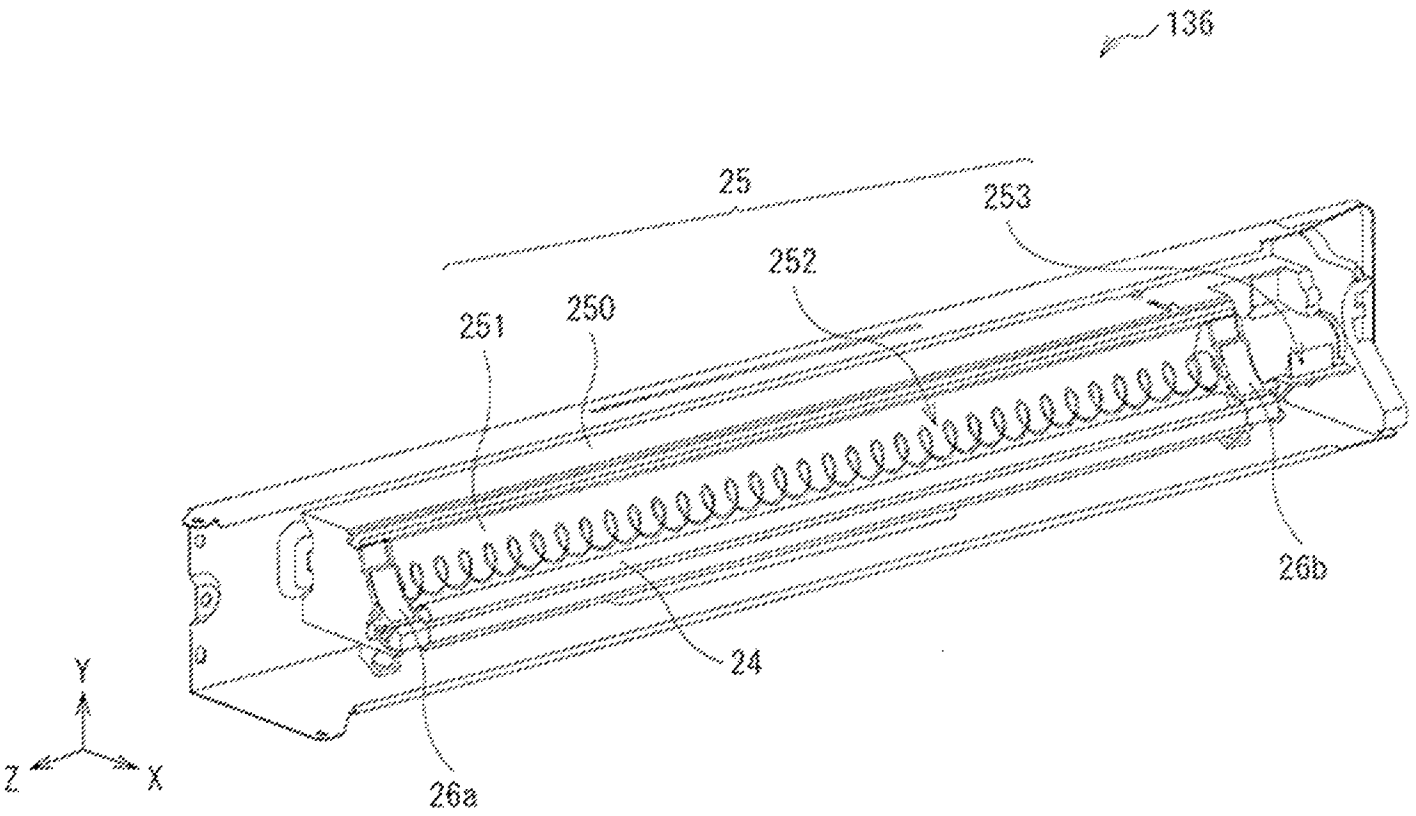
FIG. 6 is another perspective view showing a cleaning mechanism as shown in FIG. 4A in which a portion is pulled out.

Here, FIG. 4A shows a cross-sectional view (X-Y cross-sectional view) of an example of the detailed configuration of such a cleaning mechanism 136. Further, FIG. 5 and FIG. 6 show perspective views of a portion of the cleaning mechanism 136 shown in FIG. 4A when it is pulled out. In addition, the configuration shown in FIG. 6 corresponds to a configuration in which the later described seal film 20 is omitted from the configuration shown in FIG. 5 for convenience of the explanation.

As shown in FIG. 4A to FIG. 6, the cleaning mechanism 136 is provided with a seal film 20, a cleaning blade 21, a holder 22, a toner accumulation part 23, a toner supply roller 24, an excess toner carrying mechanism 25, and sponges 26*a* and 26*b*.

Here, the cleaning blade 21 corresponds to one specific example of the "cleaning member" of the present invention, the toner accumulation part 23 corresponds to one example of the "accumulation part" of the present invention, and the toner supply roller 24 corresponds to one example of the "supply member" and "supply roller" of the present invention. Further, the excess toner carrying mechanism 25 corresponds to one specific example of the "carrying mechanism" of the present invention.

The seal film 20 is arranged so as to come into contact with the intermediate transfer belt 131 to be carried on a later explained frame 250 (front face of a later explained toner supply roller 24). The seal film 20, for example, is constituted by a flexible material such as a urethane rubber material, etc.

The cleaning blade 21, as described above, is a member for scraping and removing the remaining toner remaining on the surface of the intermediate transfer belt 131. The cleaning blade 21, as shown in FIG. 4A, is arranged so as to come into counter contact (in direct contact) with the surface of the intermediate transfer belt 131 (so as to protrude in a direction opposite to the carrying direction d1 of the intermediate transfer belt 131). In this way, the remaining toner on the intermediate transfer belt 131 is scraped and removed by the cleaning blade 21 in contact with the surface of the intermediate transfer belt 131. Such a cleaning blade 21, for example, is constituted by an elastic body such as a polyurethane rubber, etc.

The holder 22, as shown in FIG. 4A, is a member for holding (attaching) the cleaning blade 21 and is fixed on a later explained frame 250. Specifically, the cleaning blade 21 is configured to be held in such a manner that the cleaning blade 21 is adhered to the holder 22.

The toner accumulation part 23, as shown in FIG. 4A, is arranged below the cleaning blade 21, more specifically below the contact portion (direct contact portion) of the cleaning blade 21 and the intermediate transfer belt 131. The toner accumulation part 23 is a part for accumulating (storing, stacking) the remaining toner removed by the cleaning blade 21, which will be explained later in detail. In addition, the toner accumulation part 23 can be configured in a manner that the toner is accumulated in advance before starting to use the image forming apparatus 1, etc., as explained later. In other words, the remaining toner can be stored in the toner accumulation part 23 at a factory.

The toner supply roller 24, as shown in FIG. 4A, is arranged so as to be accommodated in the toner accumulation part 23 and arranged at a position facing the drive roller 132*a* via the intermediate transfer belt 131. Further, the toner supply roller 24, as shown in FIG. 6, is arranged so as to extend along the width direction of the intermediate transfer belt (Z-axis direction in this example). The toner supply roller 24 is configured so as to rotate in the rotational direction d3 (rotate following the carrying operation of the intermediate transfer belt 131) as shown in FIG. 4A by being biased to the intermediate transfer belt 131 by an unillustrated bearing and a spring provided at both end portions in the extending direction. Therefore, a rotational driving force (an exclusive motor, etc.) to the toner supply roller 24 itself is not required. The toner supply roller 24 is a member for supplying the remaining toner accumulated in the toner accumulation part 23 to the surface of the intermediate transfer belt 131 as described later in detail. In addition, (the surface of) such a toner supply roller 24 is, for example, constituted by an elastic body such as a rubber material or a sponge material, etc.

The excess toner carrying mechanism 25 is a mechanism for carrying the excess of the remaining toner accumulated in the toner accumulation part 23 (excess toner) to the outside of the intermediate transfer belt unit 13 as described later in detail. The excess toner carrying mechanism 25, as shown in FIG. 4A to FIG. 6, is equipped with a frame 250, an excess toner carrying path 251, a carrying spiral 252, and a toner ejection opening 253. The carrying path 251 is defined as a carrying path for the excess toner or an excess developer carrying path.

Here, the excess toner carrying path 251 corresponds to one specific example of the "carrying path" in the present invention, the carrying spiral 252 corresponds to one specific example of the "carrying member" and the "spiral-shaped structural body" of the present invention, and the toner ejection opening 253 corresponds to one specific example of the "ejection opening" of the present invention.

The frame 250 is a frame body provided as a part of the intermediate transfer belt unit 13.

The excess toner carrying path 251, as shown in FIG. 5 and FIG. 6, is provided so as to extend along the longitudinal direction of the frame 250 (the width direction of the intermediate transfer belt 131 and the extending direction of the toner supply roller 24: Z-axis direction in this example). Further, as shown in FIG. 4A, a height difference part S is provided between the excess toner carrying path 251 and the toner accumulation part 23, in which the toner accumulation part 23 is the low part (low part side region) and the excess toner carrying path 251 is the high part (high part side region). In other words, the bottom surface of the excess toner carrying path 251 is set to be in a position that is one step higher than the bottom surface of the toner accumulation part 23. Such an excess toner carrying path 251 is configured so that the excess of the remaining toner (excess toner) accumulated in the toner accumulation part 23 is carried along the extending direction (Z-axis direction) as described later in detail.

The carrying spiral 252, as shown in FIG. 5 and FIG. 6, is arranged so as to extend along the excess toner carrying path 251 (longitudinal direction of the frame 250). The carrying spiral 252, as shown in FIG. 4A, is rotatable in the rotational direction d4 by being connected to an unillustrated motor via gears (rotationally driven by the aforementioned motor). Further, the motor, for example, is the same as the motor for rotationally driving the aforementioned drive roller 132*a*. Such a carrying spiral 252, for example, is an iron spiral-shaped structural body (spiral-shape extending along its extending direction), and is a member for carrying the aforementioned excess toner along the excess toner carrying path 251.

The toner ejection opening 253 is an opening for ejecting the excess toner carried by the carrying spiral 252 to an outside of the intermediate transfer belt unit 13. The toner ejection opening 253 in this example, as shown in FIG. 5 and FIG. 6, is formed near one of the end parts of the frame 250 (near the right side end part when viewed along the carrying direction d1 of the intermediate transfer belt 131).

The sponges 26*a* and 26*b* are arranged so as to come into contact with the drive roller 132*a* via the intermediate transfer belt 131, and are members for preventing the leaking of the remaining toner (leaking to the outside of the cleaning mechanism 136). Such sponges 26*a* and 26*b* in this example, as shown in FIG. 5 and FIG. 6, are arranged near both end parts of the frame 250.

Further, the overlapping amount ΔX as shown in FIG. 4A shows the amount of the displacement between the front end of the cleaning blade 21 and the end part of the toner accumulation part 23 (the accumulation margin at the time of dropping the remaining toner as described later), and is around ΔX=1.8 mm, for example. Furthermore, the overlapping amount ΔY as shown in FIG. 4A shows the height difference amount of the height difference part S (height of the height difference part S) between the bottom surface of the aforementioned excess toner carrying path 251 and the bottom surface of the toner accumulation part 23, and for example, is around ΔY=4.4 mm.

Figure 4B:
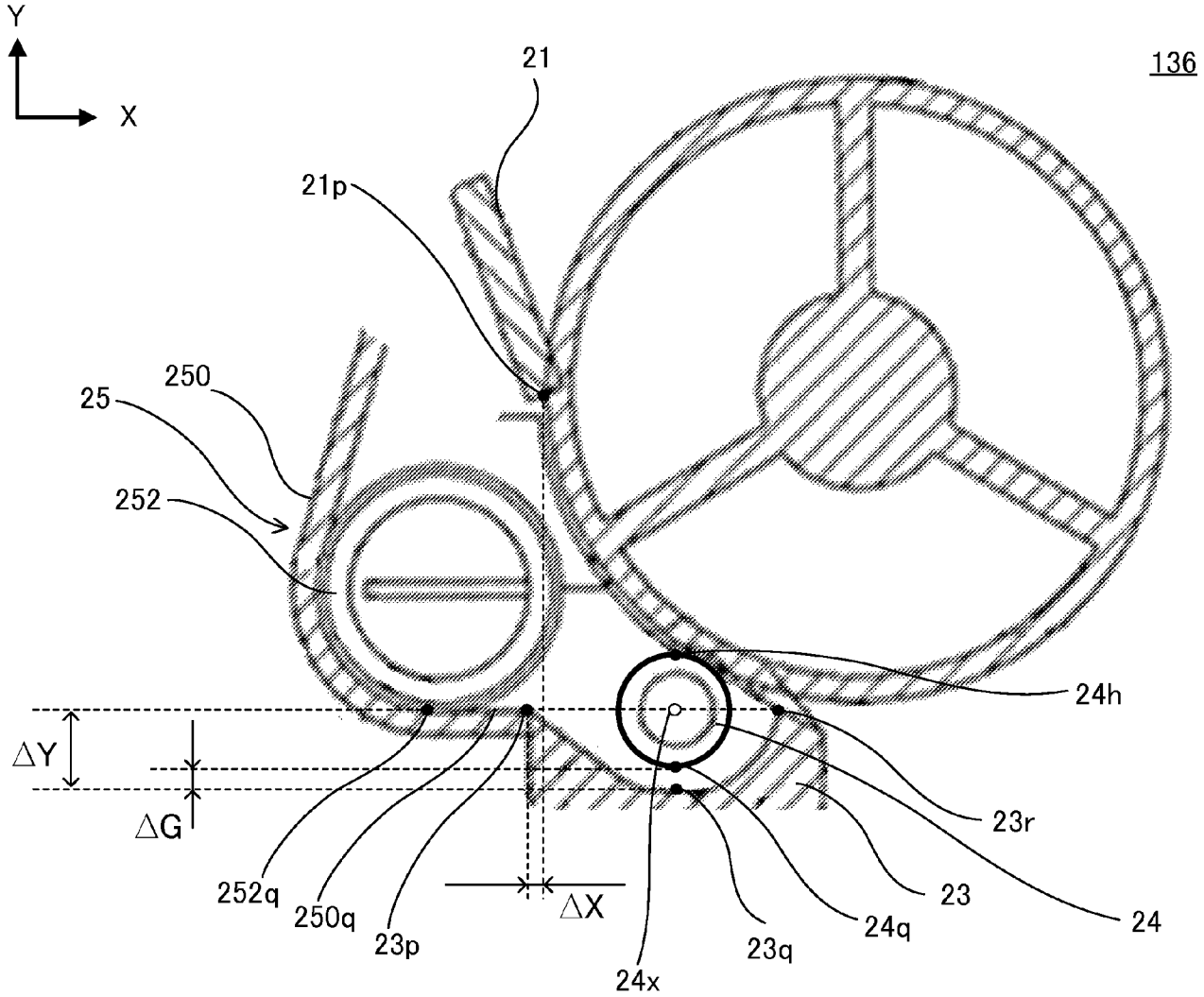
FIG. 4B is an enlarged view of FIG. 4A illustrating key components.

FIG. 4B is an enlarged view of the toner accumulation part 23, toner supply roller 24 and the excess toner carrying mechanism 25.

(Toner Accumulation Part 23)

The toner accumulation part 23 has a recess portion. The recess portion is determined by left point 23*p*, bottom point 23*q* and right point 23*r*. In the recess portion, the remaining toner removed by the cleaning blade 21 falls by the gravity and is accumulated. Thereby, the contact portion 21*p* where the tip of the cleaning blade 21 touches the surface of the intermediate transfer belt 131 has to be vertically above the toner accumulation part 23. More specifically, when the point 23*p* is determined as the downstream side, the point 23*r* as the upstream side in view of the sheet carrying direction d1, the contact portion 21*p* is positioned at the upstream side from the point 23*p* with the overlapping amount ΔX.

(Toner Supply Roller 24)

The toner supply roller 24 is arranged in the toner accumulation part 23 so that the accumulated toner in the recess portion is supplied to the intermediate transfer belt 131 by the roller 24 rotating. The bottom point 24*q* of the toner supply roller 24 is positioned above the bottom point 23*q* of the toner accumulation part 23 with a gap ΔG. A lower portion of the toner supply roller 24 is below an imaginary connecting line between the points 23*p* and 23*r*. The lower portion does not have to be a half of the roller 24.

(Excess Toner Carrying Mechanism 25 and Frame 250)

The frame 250 of the mechanism 25 has the bottom surface 250*q* of the excess toner carrying path 251. The bottom surface 250*q* is arranged at a position higher than the bottom point 23*q* of the toner accumulation part 23, forming the height different part S. The height difference between the bottom surface 250*q* and the bottom point 23*q* is shown with a height gap ΔY or the overlapping amount. The bottom surface 250*q* is connected to the recess portion of the toner accumulation part 23 at the point 23*p* (downstream point). In the embodiment, the bottom point 252*q* of the carrying spiral 252 is in contact with the bottom surface 250*q*. Thereby, when the toner in the toner accumulation part 23 overflows over the point 23*p*, the overflowing toner comes to the bottom surface 250*q*. Immediately, the toner on the bottom surface 250*q* is carried by the carrying spiral 252. As long as the carrying spiral 252 works, the top surface of the accumulated toner (or accumulated remaining toner) in the toner accumulation part 23 remains at the same height as the bottom point 252*q* of the carrying spiral and the bottom surface 250*q*. In the present invention, the excess toner (or excess developer) is defined as toner that overflows from the toner accumulation part 23 and reaches the bottom point 252*q* of the carrying spiral 252 passing over the downstream point 23*p*. In correspondence with the height gap ΔY, the height of the top surface of the accumulated toner is determined. For a smooth rotation of the toner supply roller 24, the top point 24*h* of the roller 24 is preferably positioned above the bottom point 252*q* and bottom surface 250*q*.

(Accumulated Toner's Height)

Depending on the height of the top surface of the accumulated toner in the toner accumulation part 23, the condition varies.

(1) Below the Bottom Point 24*q*

Where the top surface of the accumulated toner is below the bottom point 24*q*, the amount of the accumulated toner is too small. That is because the toner supply roller 24 is not able to supply the accumulated toner.

(2) From Bottom Point 24*q* up to Bottom Point 252*q*/Bottom Surface 250*q*

Where the top surface of the accumulated toner is from the bottom point 24*q* up to the bottom point 252*q*/bottom surface 250*q*, the amount of the accumulated toner is proper. While the toner supply roller 24 is able to supply the accumulated toner, the accumulated toner does not obstruct the rotation of the toner supply roller 24.

(3) Above the Bottom Point 252*q*/Bottom Surface 250*q*

Where the top surface of the accumulated toner is above the bottom point 252*q*/bottom surface 250*q*, the amount of the accumulated toner is too large. That is because such a large amount of the accumulated toner is likely to obstruct the rotation of the toner supply roller 24. In order to prevent such a condition, the excess toner, which is above the bottom surface 250*q*, has to be carried out with the carrying spiral 252.

(Preferred Ranges)

It is preferred that the diameter of the toner supply roller 24 is within 7 mm to 8 mm. The gap ΔG between the bottom point 24*q* of the toner supply roller 24 and the bottom point 23*q* of the toner accumulation part 23 is preferably 1 mm or less. The height gap ΔY between the bottom surface 250*q* and the bottom point 23*q* is preferably within 3.5 mm to 9 mm. Further in comparison with the diameter of the roller 24, the preferred range of the height gap ΔY per the diameter is within 50% up to 115%. In the vertical direction, the top of the height gap ΔY is preferably positioned at the same height as a rotation axis 24*x* of the toner supply roller 24 (or a half height of the roller) or above. Also, the top is preferably is positioned below the top point 24*h* of the roller 24.

(Secondary Transfer Roller 14)

The secondary transfer roller 14 as shown in FIG. 1 and FIG. 3 is arranged so as to face the aforementioned secondary transfer opposing roller 134, and is a member for electrostatically transferring (secondarily transferring) the toner image of each color primarily transferred on the intermediate transfer belt 131 along with the secondary transfer opposing roller 134 on the recording medium 120. In addition, such a secondary transfer roller 14 is, for example, constituted by a foaming semiconductive elastic rubber material.

(Fuser 15)

The fuser 15 shown in FIG. 1 is a device for fusing the toner on the recording medium 120 carried along the carrying path d2 after the aforementioned secondary transfer is performed (toner image) by applying heat and pressure to the toner. The fuser 15 is constituted so as to include, for example, a fuser belt unit and a pressure application roller (not illustrated) arranged so as to face each other via the carrying path d2 of the recording medium 120. In addition, the fuser 15, for example, is integrally attached to the image forming apparatus 1 or removably attached to the image forming apparatus 1.

Each of the carrying roller pairs 16*a*, 16*b*, and 16*c* shown in FIG. 1 is a member for carrying the recording medium 120 in which the toner is fused by the fuser 15 to the ejection roller pair 17 side. Further, the ejection roller pair 17 shown in FIG. 1 is a member for ejecting the recording medium 120 carried by the carrying roller pairs 16*a*, 16*b*, and 16*c* to the outside (mounting part 18). Specifically, in this example, as shown in FIG. 1, the recording medium 120 is configured so as to be ejected in a manner as to face down toward the mounting part 18 on the upper part cover (not illustrated) of the housing 10. In addition, the mounting part 18 is a portion to which the recording medium 120 in which an image is formed (printed) is mounted.

[Function/Effects]

(A. Basic Operation of the Entire Image Forming Apparatus 1)

In the image forming apparatus 1, an image (image layer) is formed on the recording medium 120 in the following manner. In other words, when a print job is supplied to a print control part (not illustrated) via a communication line, etc., the print control part executes the print process based on the print job so that each member in the image forming apparatus 1 performs the following operations.

That is, as shown in FIG. 1, first, the recording medium 120 stored in a sheet tray 121A or a sheet tray 121B is carried to the carrying path d2 in the following manner. That is, the recording medium 120 is separated and taken out one by one from the uppermost part by the pickup roller 122A and the separation roller pair 123A, or the pickup roller 122B and the separation roller pair 123B. Then, the removed recording medium 120 is carried to the secondary transfer roller 14 side along the carrying path d2 after the slant is corrected with the carrying roller pairs 124*a*, 124*b*, and 124*c*.

On the other hand, in each of the image forming parts 11W, 11Y, 11M, 11C, and 11K, the toner image of each color is formed by the following electrophotographic process based on the aforementioned print job.

That is, first, the surface (surface layer portion) of the photosensitive drum 111 is generally charged by the charge roller 112 in which the application voltage is supplied from a high voltage occurrence part (not illustrated). Next, when irradiation light is irradiated toward the surface of the photosensitive drum 111 from the exposure head 117, an electrostatic latent image according to the print patterns as prescribed by the aforementioned print job is formed on the photosensitive drum 111.

On the other hand, the supply roller 114 in which the application voltage is supplied from a high voltage occurrence part comes into contact with the development roller 113 in which the application voltage is similarly supplied from a high voltage occurrence part, and the supply roller 114 and the development roller 113 respectively rotate at a predetermined circumferential speed. With this, the toner is supplied to the surface of the development roller 113 from the supply roller 114.

Next, the toner on the development roller 113 is charged by the friction, etc., against a toner regulatory member (not illustrated) which is in contact with the development roller 113. Here, the thickness of the toner layer on the development roller 113 is determined by the application voltage to the development roller 113, the application voltage to the supply roller 114, and the pressing force to the toner regulatory member (the application voltage to the aforementioned toner regulatory member), etc.

Further, since the development roller 113 is in contact with the photosensitive drum 111, when the application voltage is supplied from the high voltage occurrence part to the development roller 113, the toner is adhered to the electrostatic latent image on the photosensitive drum 111 from the development roller 113.

After that, the toner (toner image) on the photosensitive drum 111 is transferred (primarily transferred) to the intermediate transfer belt 131 by the electrical field between the primary transfer roller 133 in the intermediate transfer belt unit 13. Further, the toner remaining on the surface of the photosensitive drum 111 is removed by being scraped by the cleaning blade 116 and stored in the transfer belt cleaner container (not illustrated).

In this way, the toner image of each color is formed in each of the image forming parts 11W, 11Y, 11M, 11C, and 11K, and is sequentially primarily transferred to the intermediate transfer belt 131 along the aforementioned carrying direction d1.

Next, to the recording medium 120 carried on the carrying path d2 as described above, the toner image on the intermediate transfer belt 131 is transferred (secondarily transferred) in the following manner. Specifically, as shown in FIG. 1, when the intermediate transfer belt 131 and the recording medium 120 are carried between the secondary transfer roller 14 and the secondary transfer opposing roller 134 in the intermediate transfer belt unit 13, the toner image on the intermediate transfer belt 131 is secondarily transferred onto the recording medium 120.

Next, as shown in FIG. 1, when heat and pressure are applied by the fuser 15, the toner on the recording medium 120 carried from the secondary transfer roller 14 side is fused to the recording medium 120. Specifically, a fuse operation is performed such that the recording medium 120 carried on the carrying path d2 is sandwiched by, for example, the nip parts (not illustrated) formed between a fuser belt (not illustrated) and a pressure application roller (not illustrated) and heat and pressure are applied.

Then, the recording medium 120 subjected to a fuser operation as mentioned above, as shown in FIG. 1, is ejected outside the image forming apparatus 1 (on the mounting part 18 in this example) via the carrying roller pairs 16*a*, 16*b*, and 16*c* and the ejection roller pair 17. With the above, the image forming operation in the image forming apparatus 1 is completed.

(B. Operation of the Cleaning Mechanism 136)

Here, when performing such an image forming operation, the cleaning mechanism 136 in the intermediate transfer belt unit 13 shown in FIG. 1, FIG. 3, and FIG. 4A operates in the following manner.

Figure 7:
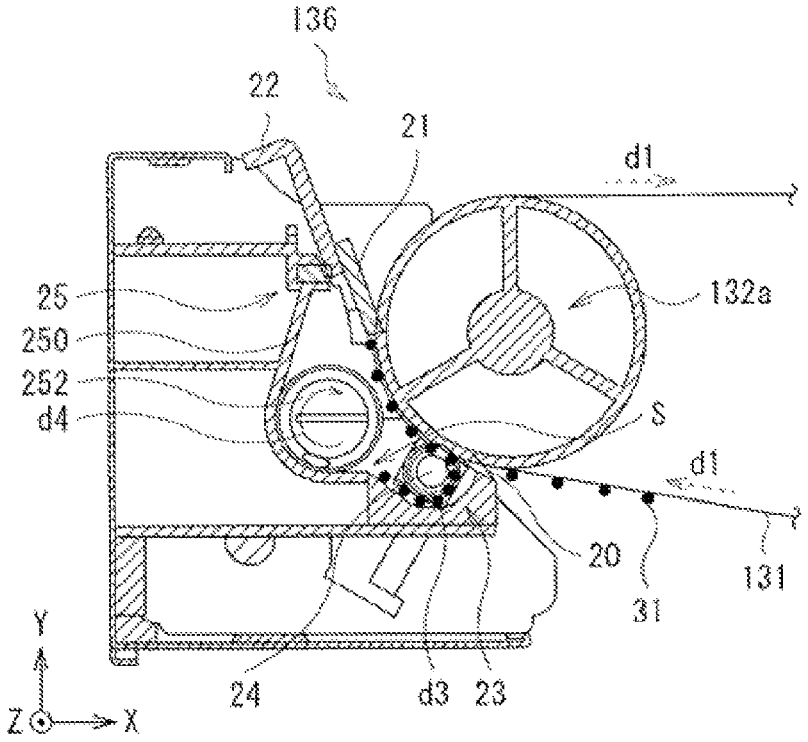
FIG. 7 is a cross-sectional view schematically showing an example of a cleaning operation of the cleaning mechanism shown in FIG. 4A.

That is, first, as shown in FIG. 7 for example, there is a case in which the surface of the intermediate transfer belt 131 carried by the drive roller 132*a*, etc., is in a state in which the remaining toner 31 (toner remaining from not being secondarily transferred on the recording medium 120, toner for image adjustment, etc.) is adhered. At this time, even when the remaining toner 31 comes into contact with the seal film 20 in the cleaning mechanism 136, the remaining toner 31 is not removed since the seal film 20 is a weak and flexible member (not scraped depending on the seal film 20). That is, as shown in FIG. 7, the intermediate transfer belt 131 is continuously carried in a state in which the remaining toner 31 is adhered to the surface. Further, the remaining toner 31 at this time corresponds to one specific example of the "remaining developer" of the present invention.

Next, when the remaining toner 31 on the surface of the intermediate transfer belt 131 reaches the contact portion with the cleaning blade 21 (direct contact portion), as shown in FIG. 7 for example, the remaining toner 31 is scraped by the cleaning blade 21. In this way, the remaining toner 31 on the surface of the intermediate transfer belt 131 is removed when the cleaning blade 21 contacts the surface of the intermediate transfer belt 131 as mentioned above, and a cleaning operation of the surface of the intermediate transfer belt 131 is performed.

Figure 8:
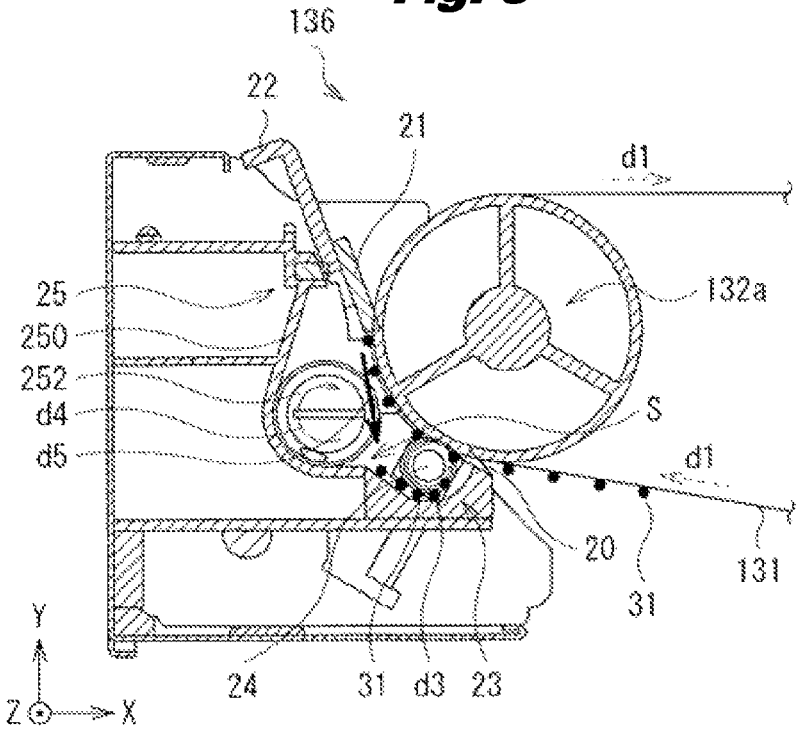
FIG. 8 is a cross-sectional view schematically showing an example of a toner accumulation operation of the cleaning mechanism shown in FIG. 4A.
Figure 9:
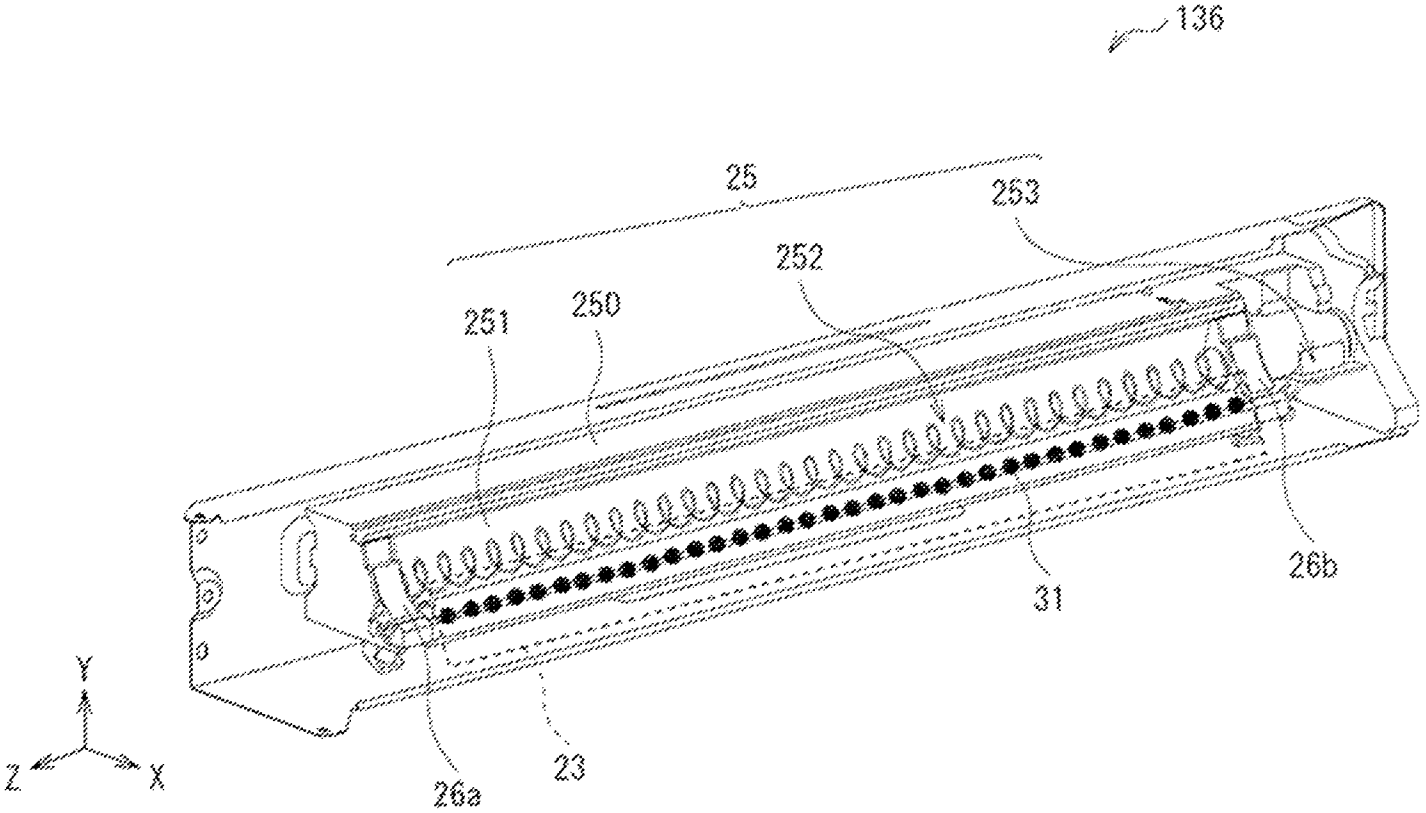
FIG. 9 is a perspective view schematically showing a toner accumulation state.

At this time, as shown by the arrow d5 in FIG. 8, for example, the remaining toner 31 scraped (removed) by the cleaning blade 21 drops downward from the contact portion of the cleaning blade 21 and the intermediate transfer belt 131. Then, since the toner accumulation part 23 is provided below the contact portion, as shown in FIG. 8 and FIG. 9 for example, the dropped remaining toner 31 is accumulated (stacked) in the toner accumulation part 23 (the accumulation operation of the remaining toner 31 is performed).

(Comparative Example)

Here, generally, a toner is known to function as a lubricant agent between a cleaning blade and a transfer belt. Therefore, by supplying (adhering) the remaining toner 31 accumulated at the toner accumulation part 23 as described above to the surface of the intermediate transfer belt 131, a method for prolonging the life of the cleaning blade 21 can be considered.

However, as explained below, when the remaining toner accumulated in the toner accumulation part is supplied to the surface of the intermediate transfer belt as it is (directly) (in Comparative Example as an example of a virtual configuration), for example, the following problems (a) to (d) may arise.

(a) Since the amount of the remaining toner changes according to the content of the toner image (printing pattern) that is primarily transferred to the surface of the intermediate transfer belt (there may be cases in which the remaining toner barely exists), it is difficult to stably supply the remaining toner to the surface of the intermediate transfer belt.

(b) Since the accumulated remaining toner may barely exist at the time of starting the image forming apparatus (intermediate transfer belt unit), etc. (after the vibration during use), it is also difficult to stably supply a remaining toner to the intermediate transfer belt in such a case.

(c) In a case in which a medium including a lot of paper powder is used as a recording medium, when the amount of paper powder scraped by the remaining toner by the cleaning blade increases (when the paper powder locally accumulates in the toner accumulation part), for example, an inconvenience referred to as a so-called "toner scrape through" may occur. That is, when such a large amount of paper powder accumulated locally is supplied to the surface of the intermediate transfer belt, it may become clogged at the contact portion of the cleaning blade and the intermediate transfer belt. When that happens, the remaining toner that was originally supposed to be removed is not scraped at the contact portion, and a phenomenon in which it is scraped through the cleaning blade may occur. Further, when such paper powders clog, damage may occur on the cleaning blade, becoming a cause of damage.

(d) When the remaining toner accumulates too much, "toner scrape through" or damages to the cleaning blade may occur similarly to the aforementioned (c), due to the increase in the pressure by the remaining toner at the contact portion of the cleaning blade and the intermediate transfer belt.

(Effects of the Embodiment)

In the cleaning mechanism 136 of this embodiment, for example as shown in FIG. 4A and FIG. 7, a toner supply roller 24 for supplying the remaining toner 31 accumulated in the toner accumulation part 23 to the surface of the intermediate transfer belt 131 is provided. The following happens when such toner supply roller 24 rotates together with the intermediate transfer belt 131 while in contact with it in the toner accumulation part 23.

That is, for example, as shown in FIG. 8, the remaining toner 31 accumulated in the toner accumulation part 23 is always in contact with and adhered to the surface of the toner supply roller 24, and it adheres again to the surface of the intermediate transfer belt 131 while being stirred in the toner accumulation part 23. Further, at this time, when the surface of the toner supply roller 24 is constituted by an elastic body, the surface of the toner supply roller 24 is evenly (approximately evenly) in contact with the surface of the intermediate transfer belt 131, and the adhesion unevenness when the remaining toner 31 is adhered again can be suppressed.

Therefore, in this embodiment, in contrast to the aforementioned Comparative Example, as described in the aforementioned (a), the following happens even when the amount of the remaining toner 31 changes according to the content (print pattern) of the toner image to be primarily transferred to the surface of the intermediate transfer belt 131 (a case in which remaining toner 31 is barely present). That is, as a result that the remaining toner 31 accumulated in the toner accumulation part 23 is stably supplied to the surface of the intermediate transfer belt 131 by the toner supply roller 24, the life of the cleaning blade 21 is prolonged from the effects of the aforementioned toner as a lubricant agent.

Also, for example, as shown in FIG. 7, when the toner is accumulated in the toner accumulation part 23 in advance before starting to use the image forming apparatus 1, etc., the following happens. That is, the toner accumulated in the toner accumulation part 23 in advance is supplied to the surface of the intermediate transfer belt 131 by the toner supply roller 24, and even before the start of such a use, etc., the toner is stably supplied in contrast to the aforementioned Comparative Example (b). As a result, an initial damage to the cleaning blade 21 is prevented, and the life of the cleaning blade 21 can be further prolonged.

Further, in this embodiment, as explained in the aforementioned (c), even when a medium including a lot of paper powder is used as the recording medium 120, for example, the following happens. That is, even when the amount of the paper powder and the remaining toner 31 accumulated in the toner accumulation part 23 is large (when the paper powder is locally accumulated in the toner accumulation part 23), since such paper powders are also stirred by the toner supply roller 24, the paper powder is prevented from accumulating locally. As a result, since the occurrences of inconveniences such as the aforementioned "toner scraper through" is avoided and damages to the cleaning blade 21 caused by it is also prevented, the life of the cleaning blade 21 can be further prolonged from this point of view.

Further, in the cleaning mechanism 136 of this embodiment, for example as shown in FIG. 4A, a carrying mechanism 25 for carrying the excess of the remaining toner 31 accumulated in the toner accumulation part 23 (excess toner) toward outside is further provided.

Figure 10:
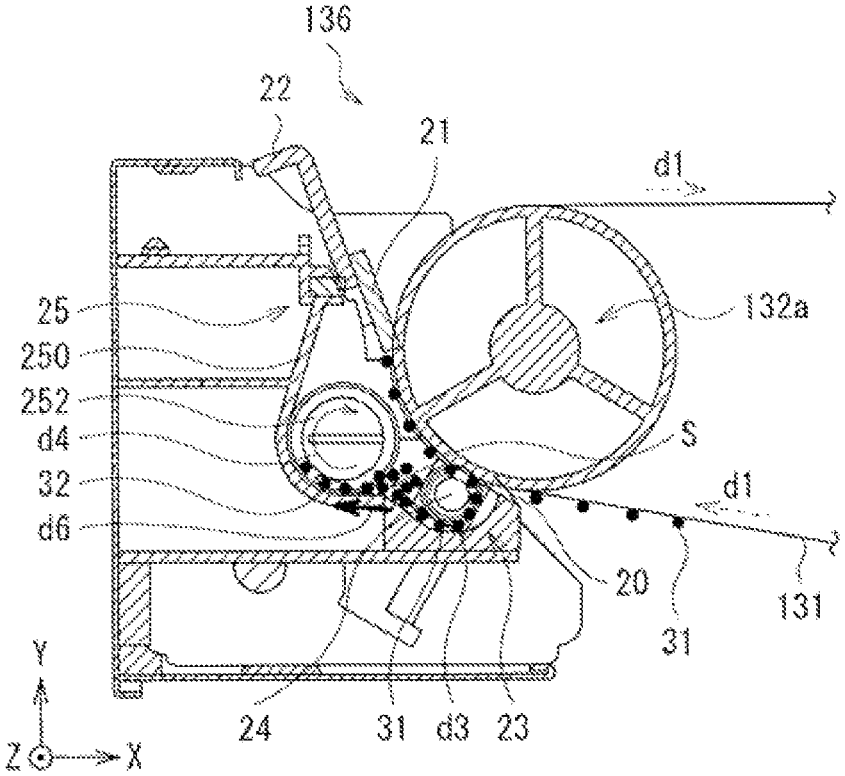
FIG. 10 is a cross-sectional view schematically showing one example of an excess toner carrying operation of the cleaning mechanism shown in FIG. 4A.

With this, for example, as shown in FIG. 10, a carrying operation to carry such excess toner to the outside is performed, and the remaining toner 31 can be prevented from over-accumulating in the toner accumulation part 23 as explained in the aforementioned (d).

Specifically, first, as shown by the arrow d6 in FIG. 10, for example, when the amount of the remaining toner 31 accumulated in the toner accumulation part 23 increases and reaches the height of the height difference part S (bottom face of the excess toner carrying path 251), the following happens. That is, the excess of the accumulated remaining toner 31 (excess toner 32) goes over the height difference part S and (automatically) moves to the excess toner carrying path 251 (excess toner carrying mechanism 25) side. Further, the excess toner 32 at this time corresponds to one specific example of the "excess developer" of the present invention.

Figure 11:
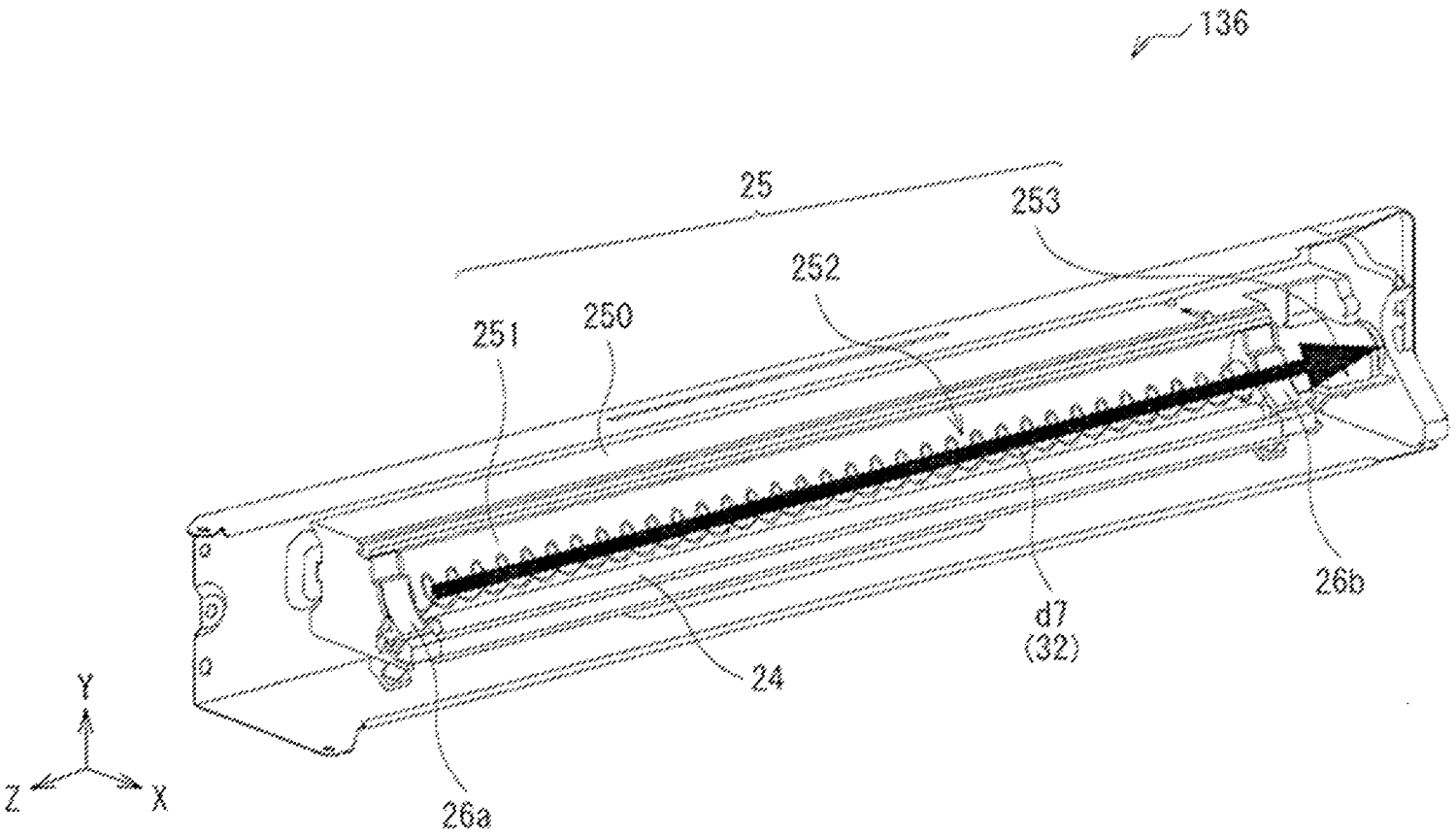
FIG. 11 is a perspective view schematically showing another example of an excess toner carrying operation.

Then, since the carrying spiral 252 rotates in the excess toner carrying path 251, for example, as shown by the arrow d7 in FIG. 11, the excess toner 32 in contact with the carrying spiral 252 is carried along the excess toner carrying path 251. Further, since the excess toner 32 carried in such a manner is ejected to the outside from the toner ejection opening 253, the amount of the remaining toner 31 accumulated in the toner accumulation part 23 is restricted to be below a certain amount. Therefore, as described above, as a result of preventing the remaining toner 31 from over-accumulating in the toner accumulation part 23, in contrast to the aforementioned Comparative Example (d), the occurrences of "toner scrape through" and damages to the cleaning blade 21 due to the increase in the pressure by the remaining toner 31 can be prevented. With this, the life of the cleaning blade 21 can be further prolonged.

As described above, in this embodiment, since the toner supply roller 24 for supplying the remaining toner 31 accumulated in the toner accumulation part 23 to the surface of the intermediate transfer belt 131 is provided, even if the amount of the remaining toner 31 remaining on the surface of the intermediate transfer belt 131 changes, the accumulated remaining toner 31 can be stably supplied to the surface of the intermediate transfer belt 131. Therefore, using the functions of the toner as a lubricant agent, abrasion or "turn-up" of the cleaning blade 21 can be prevented, and for example, in comparison with the method of the aforementioned Comparative Example, it is possible to prolong the life of the cleaning blade 21.

<2. Modified Examples>

Next, modified examples of the aforementioned embodiment (modified examples 1 to 5) will be explained. Further, for components in common with the embodiments, the same symbols will be used and the explanation will be omitted.

[Modified Example 1]

(A. Structure)

Figure 12A:
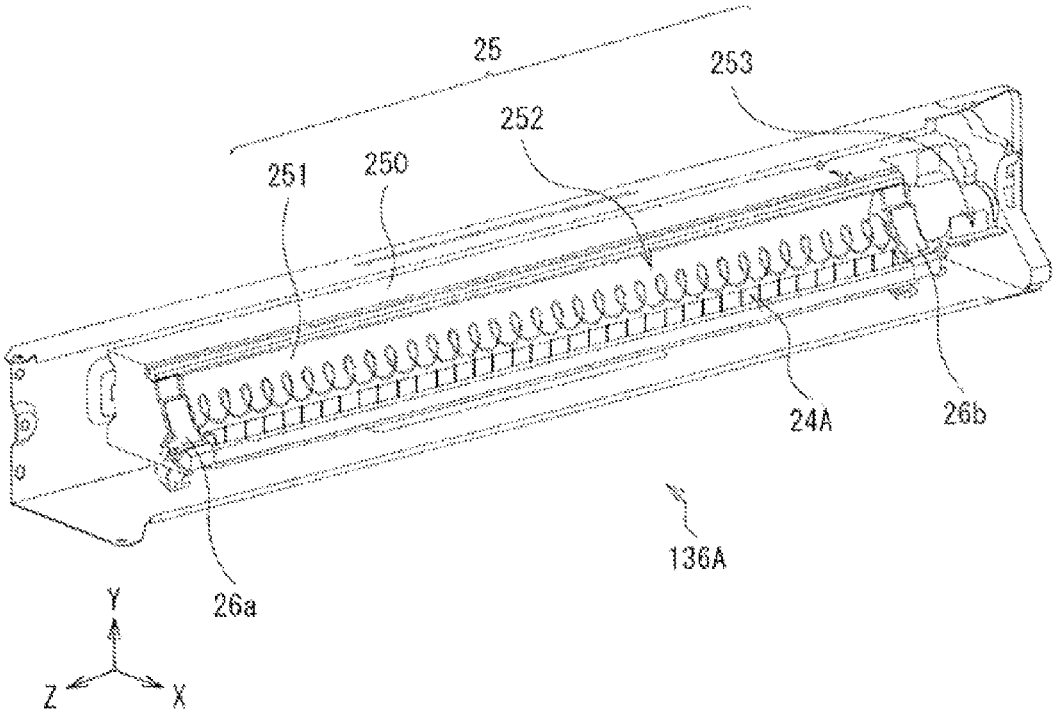
FIG. 12A and FIG. 12B show examples of the main configurations of the cleaning mechanism according to Modified Example 1.
Figure 12B:
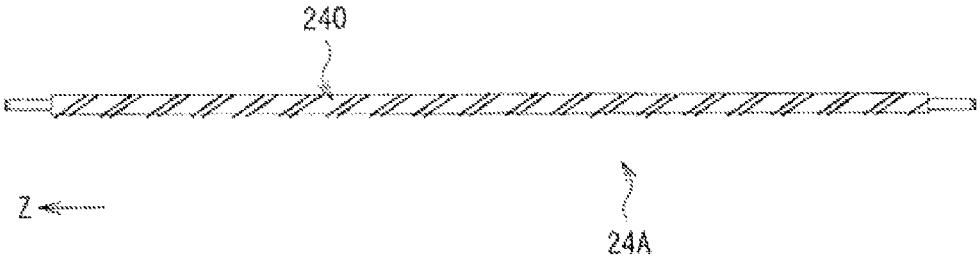

FIG. 12A and FIG. 12B show examples of configurations of the main parts of the cleaning mechanism (cleaning mechanism 136A) according to Modified Example 1. Specifically, FIG. 12A shows a perspective view of an example of configuration of an outer appearance of a main part of a cleaning mechanism 136A. Further, FIG. 12B shows an example of the detailed configuration of the later explained toner supply roller 24A shown in FIG. 12A.

The cleaning mechanism 136A of this modified example, as shown in FIG. 12A and FIG. 12B, corresponds to the cleaning mechanism 136 described in the embodiment in which a later explained toner supply roller 24A is provided in place of the toner supply roller 24, but the other configurations are the same. In addition, the toner supply roller 24A corresponds to one specific example of the "supply member" or the "supply roller" of the present invention.

The toner supply roller 24A, as shown in FIG. 12B, for example, corresponds to the toner supply roller 24 in which a spiral-shaped ditch part 240 is formed along the extending direction, and the other structures are basically the same. Since such a spiral-shaped ditch part 240 is formed, the following happens and the details will be explained later. That is, the remaining toner 31 accumulated in the toner accumulation part 23 is supplied to the surface of the intermediate transfer belt 131 and is carried (automatically moves) along the longitudinal direction (width direction of the intermediate transfer belt 131: Z-axis direction in this example) of the toner accumulation part 23.

(B. Operation)

The cleaning mechanism 136A operates in the following manner, for example, using the aforementioned toner supply roller 24A. Here, the operational example of the cleaning mechanism 136A will be explained for each of the cases in which the print pattern range on the intermediate transfer belt 131 before the primary transfer is near the central region, near the left side region, and near the right side region of the width direction (Z-axis direction) of the intermediate transfer belt 131.

In addition, "left" and "right" in this explanation refer to the directions when viewed along the carrying direction d1 of the intermediate transfer belt 131, and are the same hereinafter. Also, since the basic operations of the cleaning mechanism 136A are the same as the operations of the cleaning mechanism 136, the explanation will be omitted.

(Print Pattern Range: when near the Central Region)

First, each of FIG. 13A to FIG. 13D schematically show an operational example of the cleaning mechanism 136A when the aforementioned print pattern range is near the central region in the width direction of the intermediate transfer belt 131.

Figure 13A:
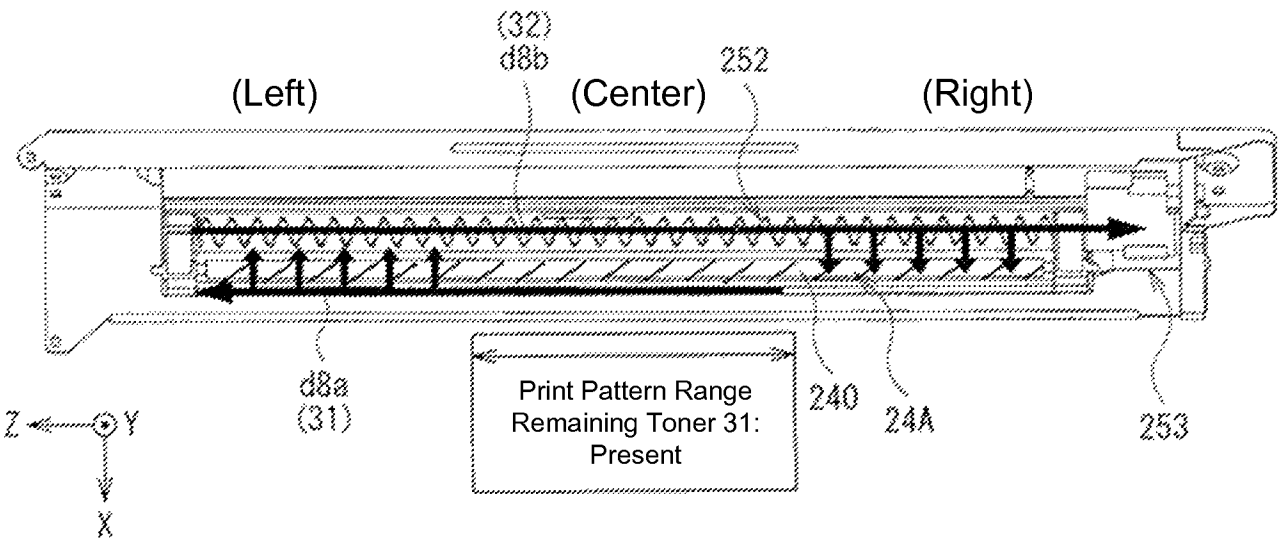
FIG. 13A is a schematic view showing an operational example when a print pattern range is near a central region.
Figure 13B:
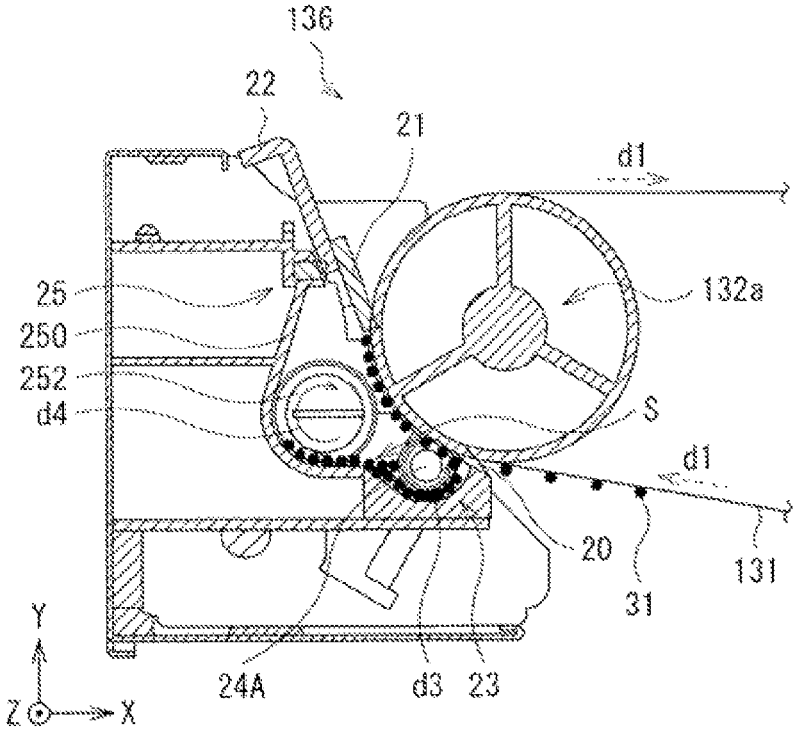
FIG. 13B is a cross-sectional view schematically showing an operational example when the print pattern range is near the central region shown in FIG. 13A.

In this case, first, for example, as shown in FIG. 13A and FIG. 13B, the remaining toner 31 remaining on the surface of the intermediate transfer belt 131 near its central region is scraped by the cleaning blade 21 and accumulated near the central region in the width direction of the toner accumulation part 23. Then, the remaining toner 31 accumulated near the central region of the toner accumulation part 23 is supplied to the surface of the intermediate transfer belt 131 near its central region by the toner supply roller 24A.

Figure 13C:
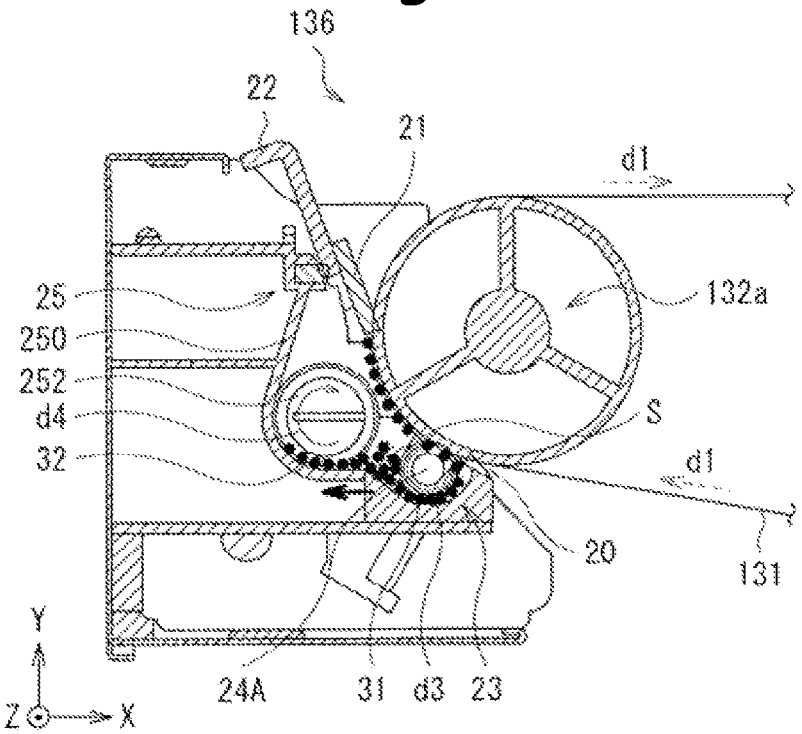
FIG. 13C is a cross-sectional view schematically showing an operational example the print pattern range is near the left side region shown in FIG. 13A.

Also, at this time, as shown in FIG. 13C, for example, at near the left side region as shown in FIG. 13A, the remaining toner 31 does not exist on the surface of the intermediate transfer belt 131. However, as shown in FIG. 13A, for example, since a spiral-shaped ditch part 240 is formed on the surface of the toner supply roller 24A, the following happens. That is, as shown by the arrow d8*a* in FIG. 13A, the remaining toner 31 accumulated near the central region of the toner accumulation part 23 is gradually carried (moved) toward the left side in the toner accumulation part 23 while being supplied to the surface of the intermediate transfer belt 131 near its central region as described above. Also, since the toner ejection opening 253 is not provided near the left side region, as shown in FIG. 13A and FIG. 13C, for example, the excess of the remaining toner 31 accumulated near the left side region of the toner accumulation part 23 (excess toner 32) moves to the excess toner carrying path 251. Next, the excess toner 32 carried to the excess toner carrying path 251, as shown by the arrow d8*b* in FIG. 13A, for example, is carried by the carrying spiral 252 near to the right side region of the excess toner carrying path 251. Then, for example, as shown in FIG. 13A, a part of the excess toner 32 is ejected outside from the toner ejection opening 253 provided at the end portion in the right side region.

Figure 13D:
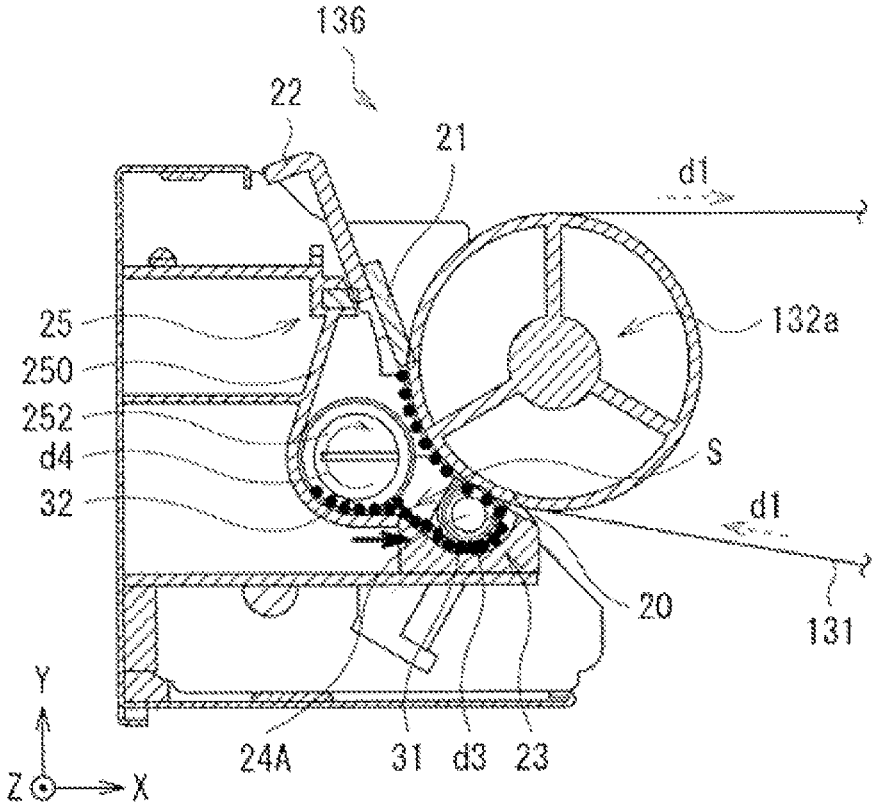
FIG. 13D is a cross-sectional view schematically showing an operational example the print pattern range is near the right side region shown in FIG. 13A.

At this time, as shown in FIG. 13D, for example, at near the right side region as shown in FIG. 13A, in the same manner as it was near the aforementioned left side region, the remaining toner 31 does not exist on the surface of the intermediate transfer belt 131. However, as shown in FIG. 13A and FIG. 13D for example, a part of the excess toner 31 carried by the carrying spiral 252 drops to the toner accumulation part 23 from the excess toner carrying path 251 and is accumulated near the right side region of the toner accumulation part 23.

(Print Pattern Range: when near the Left Side Region)

Figure 14A:
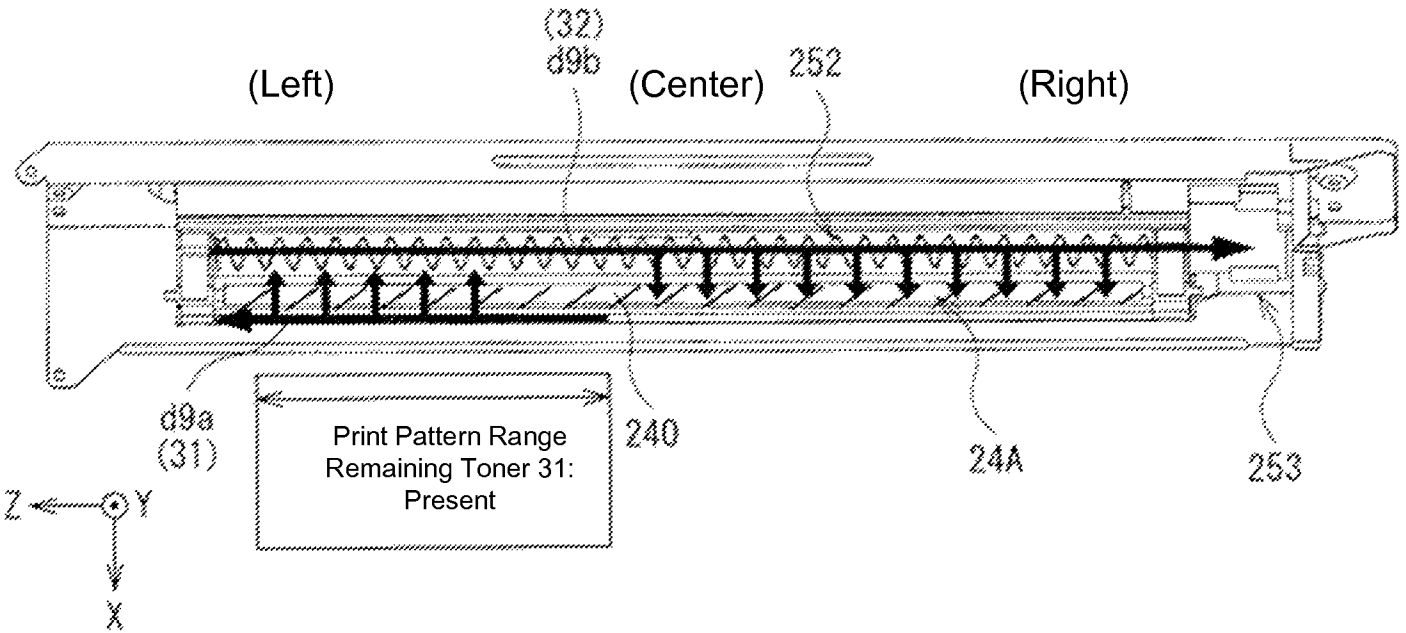
FIG. 14A is a schematic view showing an operational example when the print pattern range is near the left side region.
Figure 14B:
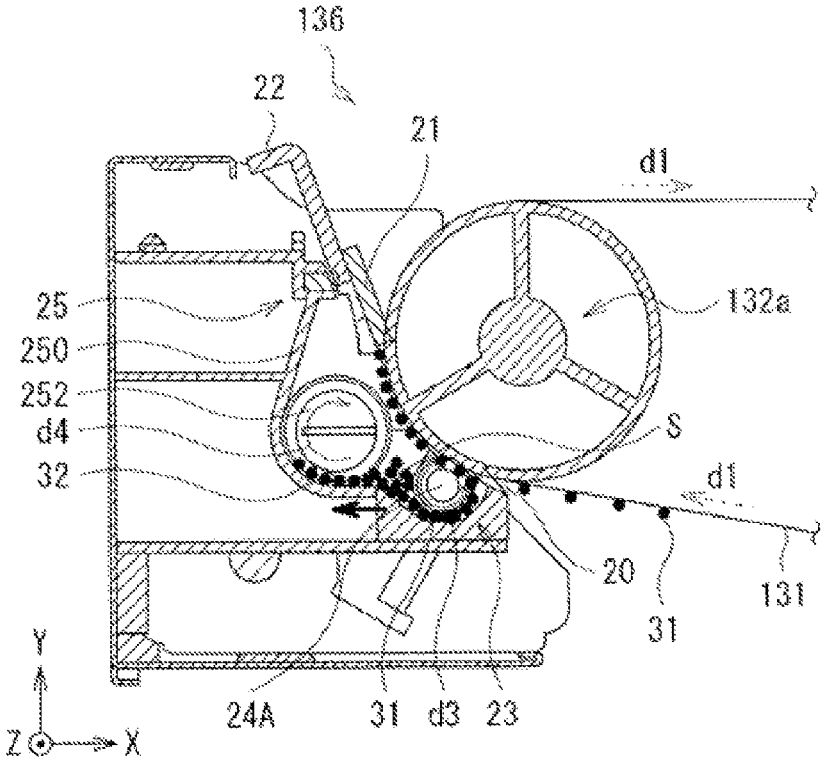
FIG. 14B is a cross-sectional view schematically showing an operational example when the print pattern range is near the left side region shown in FIG. 14A.
Figure 14C:
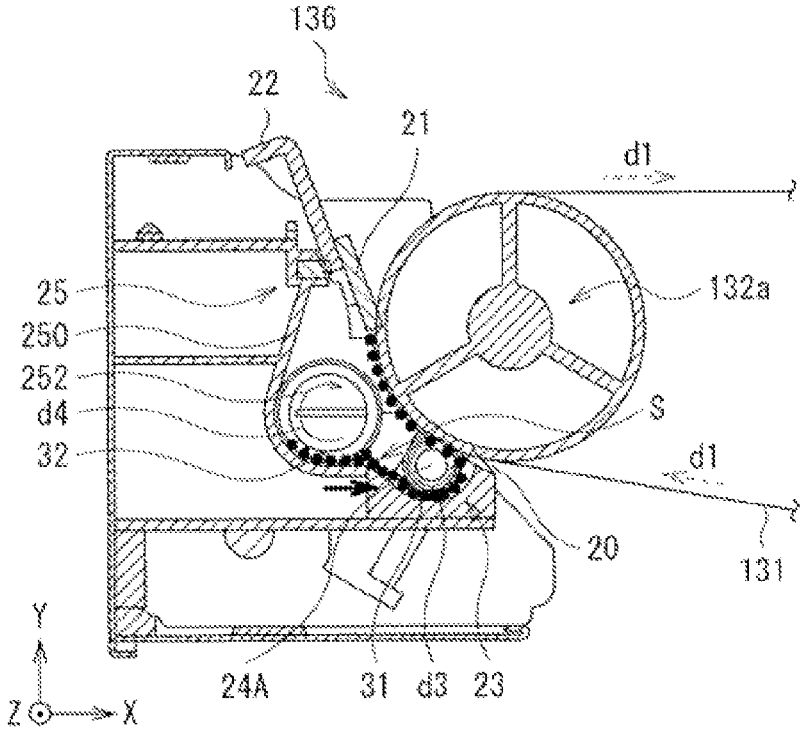
FIG. 14C is a cross-sectional view schematically showing an operational example when the print pattern range is near the central region and the right side region shown in FIG. 14A.

Next, each of FIG. 14A to FIG. 14C schematically show an operational example of the cleaning mechanism 136A when the aforementioned print pattern range is near the left side region in the width direction of the intermediate transfer belt 131.

In this case, first, for example, as shown in FIG. 14A and FIG. 14B, the remaining toner 31 remaining on the surface of the intermediate transfer belt 131 near its left side region is scraped by the cleaning blade 21 and accumulated near the left side region in the width direction of the toner accumulation part 23. Then, the remaining toner 31 accumulated near the left side region of the toner accumulation part 23 is supplied to the surface of the intermediate transfer belt 131 near its left side region by the toner supply roller 24A.

Also, at this time, as shown in FIG. 14C, for example, near the central region and near the right side region as shown in FIG. 14A, the remaining toner 31 does not exist on the surface of the intermediate transfer belt 131. However, as shown in FIG. 14A, for example, since a spiral-shaped ditch part 240 is formed on the surface of the toner supply roller 24A, the following happens. That is, as shown by the arrow d9*a* in FIG. 14A, the remaining toner 31 accumulated near the left side region of the toner accumulation part 23 is gradually carried toward the left side in the toner accumulation part 23 while being supplied to the surface of the intermediate transfer belt 131 near its left side region as described above. Also, since the toner ejection opening 253 is not provided near the left side region, as shown in FIG. 14A and FIG. 14B, for example, the excess of the remaining toner 31 accumulated near the left side region of the toner accumulation part 23 (excess toner 32) moves to the excess toner carrying path 251. Next, the excess toner 32 carried to the excess toner carrying path 251, as shown by the arrow d9*b* in FIG. 14A, for example, is carried near the central region and near the right side region of the excess toner carrying path 251 by the carrying spiral 252. Then, for example, as shown in FIG. 14A, a part of the excess toner 32 is ejected outside from the toner ejection opening 253 provided at the end portion in the right side region.

Further, at this time, as shown in FIG. 13A and FIG. 13C for example, a part of the excess toner 31 carried by the carrying spiral 252 drops to the toner accumulation part 23 from the excess toner carrying path 251 and is accumulated in each of the regions near the central region and near the right side region of the toner accumulation part 23.

(Print Pattern Range: when near the Right Side Region)

Next, FIG. 15A to FIG. 15D respectively schematically show an operational example of the cleaning mechanism 136A when the aforementioned print pattern range is near the right side region in the width direction of the intermediate transfer belt 131.

Figure 15A:
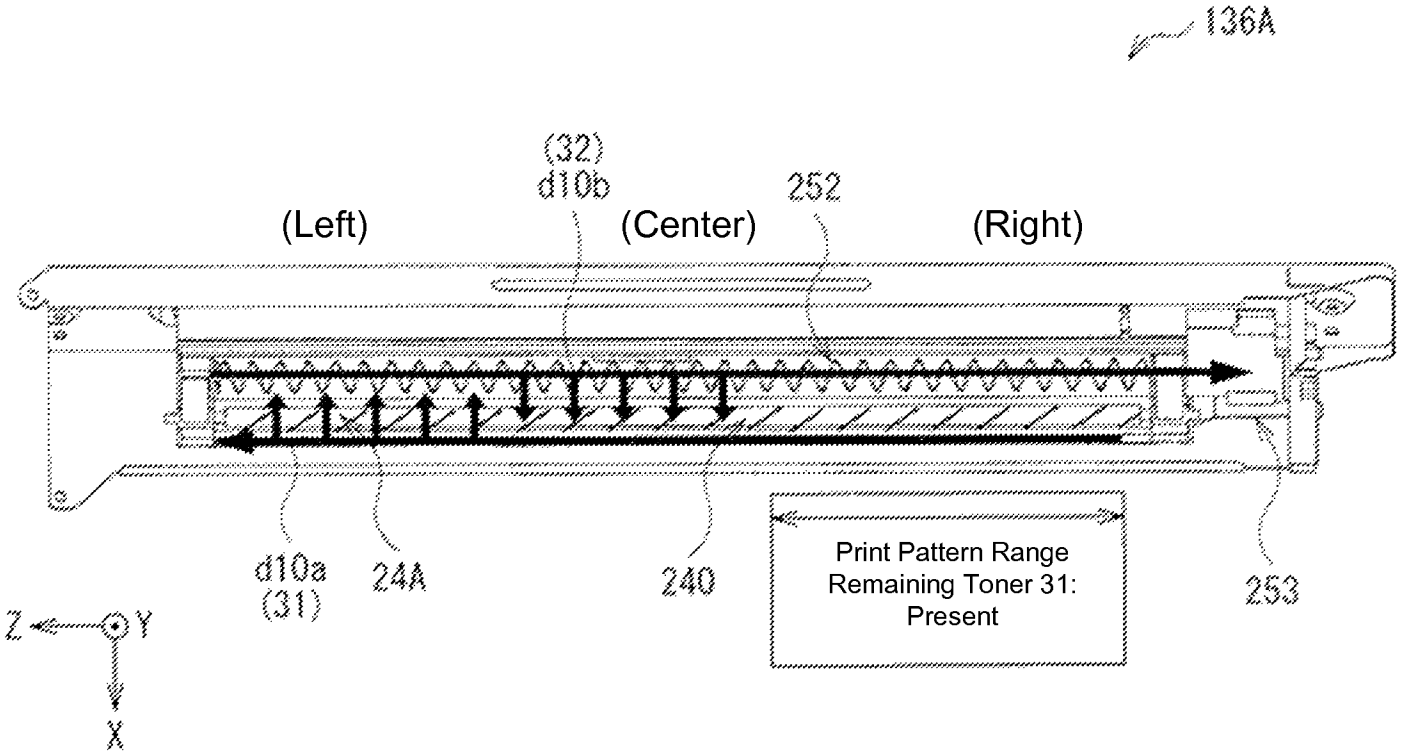
FIG. 15A is a schematic view showing an operational example when a print pattern range is near the right side region.
Figure 15B:
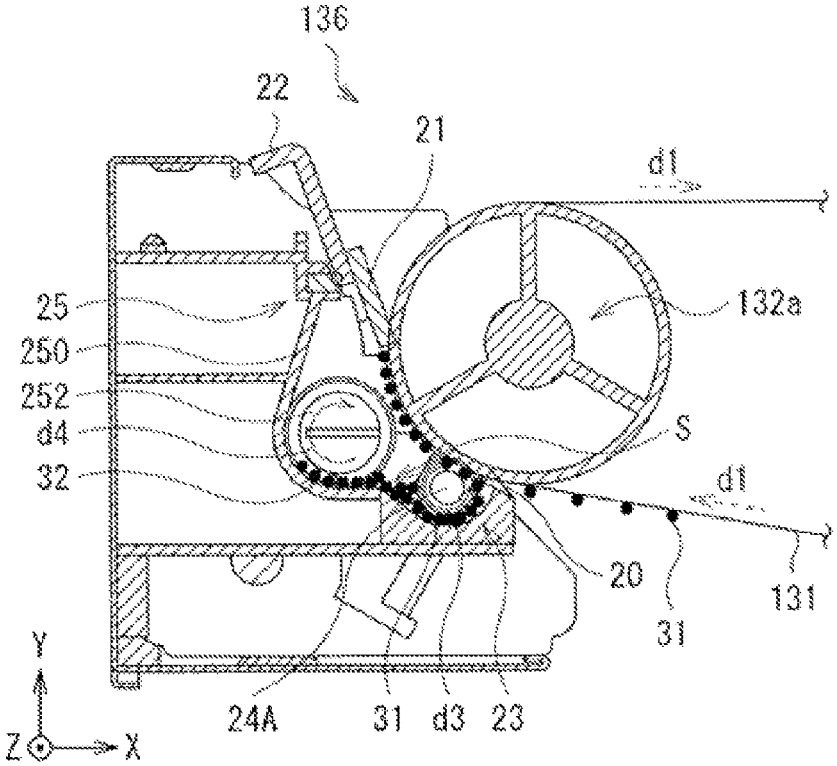
FIG. 15B is a cross-sectional view schematically showing an operational example when the print pattern range is near the right side region shown in FIG. 15A.

In this case, first, for example, as shown in FIG. 15A and FIG. 15B, the remaining toner 31 remaining on the surface of the intermediate transfer belt 131 near its right side region is scraped by the cleaning blade 21 and accumulated near the right side region in the width direction of the toner accumulation part 23. Then, the remaining toner 31 accumulated near the right side region of the toner accumulation part 23 is supplied to the surface of the intermediate transfer belt 131 near its right side region by the toner supply roller 24A.

Figure 15C:
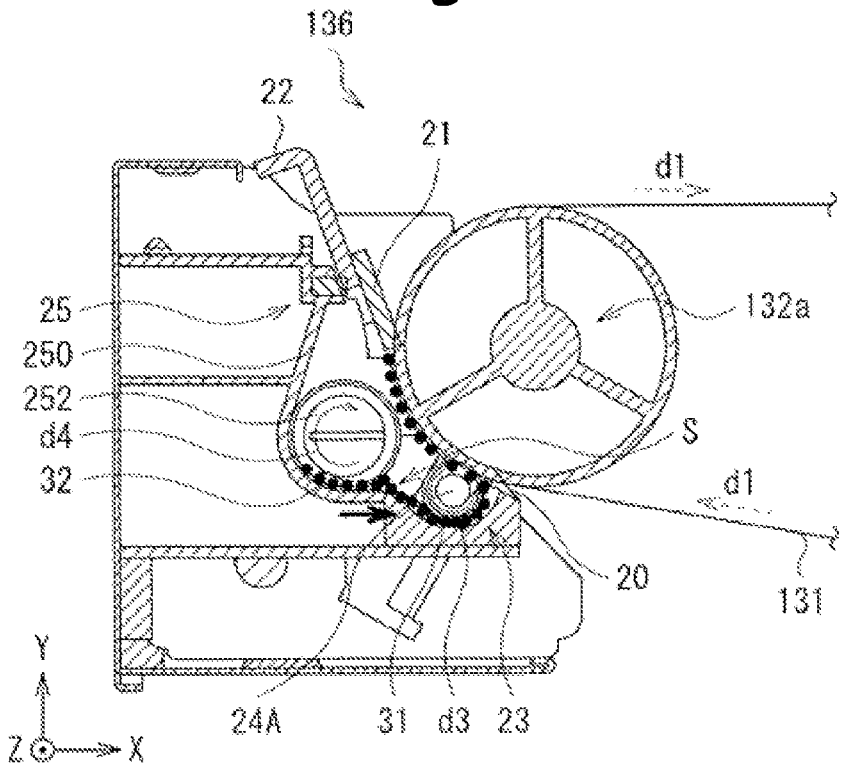
FIG. 15C is a cross-sectional view schematically showing an operational example when the print pattern range is near the central region shown in FIG. 15A.

Also, at this time, as shown in FIG. 15C, for example, at near the central region as shown in FIG. 15A, the remaining toner 31 does not exist on the surface of the intermediate transfer belt 131. However, as shown in FIG. 15A, for example, since a spiral-shaped ditch part 240 is formed on the surface of the toner supply roller 24A, the following happens. That is, as shown by the arrow d10*a* in FIG. 15A, the remaining toner 31 accumulated near the right side region of the toner accumulation part 23 is gradually carried (moves) toward the left side in the toner accumulation part 23*b* while being supplied to the surface of the intermediate transfer belt 131 near its right side region as described above.

Figure 15D:
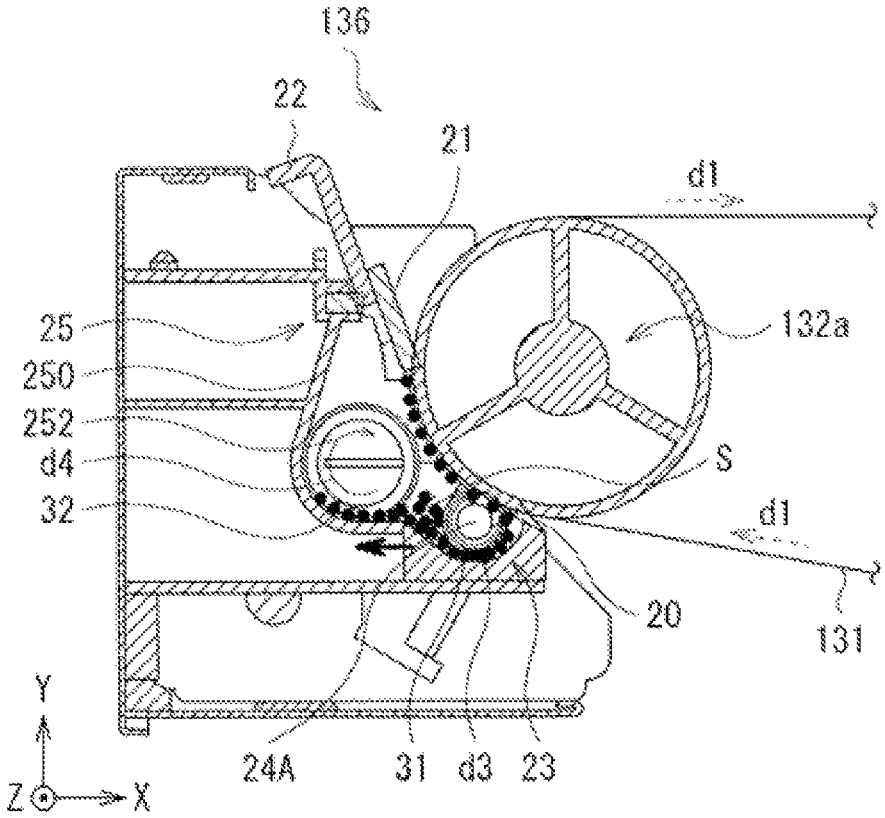
FIG. 15D is a cross-sectional view schematically showing an operational example when the print pattern range is near the left side region shown in FIG. 15A.

Further, as shown in FIG. 15D, for example, also at near the left side region as shown in FIG. 15A, in the same manner as at near the aforementioned central region, the remaining toner 31 does not exist on the surface of the intermediate transfer belt 131. However, as described above, since the remaining toner 31 is gradually carried toward the left side in the toner accumulation part 23, and the toner ejection opening 253 is not provided near the left side region, the following happens. That is, as shown in FIG. 15A and FIG. 15D, for example, the excess of the remaining toner 31 accumulated near the left side region of the toner accumulation part 23 (excess toner 32) moves to the excess toner carrying path 251. Next, the excess toner 32 carried to the excess toner carrying path 251, as shown by the arrow d10*b* in FIG. 15A, for example, is carried by the carrying spiral 252 toward the right side on the excess toner carrying path 251. Then, for example, as shown in FIG. 15A, a part of the excess toner 32 is ejected outside from the toner ejection opening 253 provided at the end portion in the right side region.

Further, at this time, as shown in FIG. 15A and FIG. 15C for example, a part of the excess toner 31 carried by the carrying spiral 252 drops to the toner accumulation part 23 from the excess toner carrying path 251 near the central region and is accumulated near the central region of the toner accumulation part 23.

(C. Functions/Effects)

In this way, in the cleaning mechanism 136A of this modified example, the remaining toner 31 is carried along the width direction of the intermediate transfer belt 131 by the spiral-shaped ditch part 240 on the surface of the toner supply roller 24A. Further, the excess toner 32 is carried by the carrying spiral 252 along the excess toner carrying path 251, that is, along the width direction of the intermediate transfer belt 131, and a part of it is ejected outside from the toner ejection opening 253. That is, even when the aforementioned print pattern range exists in any region in the width direction of the intermediate transfer belt 131, the remaining toner 31 and the excess toner 32 do not rely on the region and exist in any region in this width direction, so the exchanging of the toners occurs at all times. In addition, an exclusive driving mechanism is not required for the control of such exchanging operation of the toner (moving control of toners), and it is realized only by a rotational driving force using the driving mechanism in the intermediate transfer belt unit 13 originally provided.

Therefore, in this modified example, it is possible to resolve the following problem, which may be caused when the spiral-shaped ditch part 240 is not formed on the surface of the toner supply roller 24A.

That is, first, for example, when the recording medium 120 is a very long sheet, since the same print patterns are printed continuously for a long time, there may be a difference in the frequency of the exchanging of the accumulated remaining toner 31 depending on the place in the longitudinal direction of the toner accumulation part 23 when the aforementioned spiral-shaped ditch part 240 is not formed. That is, when a print pattern exists, since the remaining toner 31 is rapidly accumulated in the toner accumulation part 23 in the region in which the remaining toner 31 exists on the surface of the intermediate transfer belt 131 among the width direction, the excess toner 32 also occurs frequently.

On the other hand, when a print pattern does not exist, the remaining toner 31 is barely accumulated in the toner accumulation part 23 in the region in which the remaining toner 31 does not (barely) exist on the surface of the intermediate transfer belt 131 among the width direction, the excess toner 32 also barely occurs. In this way, in such a region in which the excess toner 32 barely occurs, since the exchanging of the toners barely occurs, the accumulated toner (remaining toner 31) deteriorates (the freshness of the toner decreases) with time. When the toner deteriorates in such a manner, for example, the grain diameter of the toner may be reduced (diameter reduction), the shape of the toner may become warped and not spherical, and the flowability of the toner may decrease from the reduction in the ratio of external additives. Any of such phenomena may become a cause of occurrence of inconvenience such as the aforementioned "toner scrape through", etc.

On the other hand, in this modified example, as described above, since the spiral-shaped ditch part 240 is formed on the surface of the toner supply roller 24A, even when the recording medium 120 is a very log sheet and the same print patterns are printed continuously for a long time, such problems are resolved. That is, even when the print pattern range exists in any region in the width direction of the intermediate transfer belt 131, the exchanging of toners occurs at all times in any region in the width direction without depending on the region. Therefore, as a result of suppression of the deterioration (decrease in the freshness of the toners) of the toner accumulated in the toner accumulation part 23 (remaining toner 31) with time, inconveniences such as the aforementioned "toner scrape through", etc., can be prevented, and it is possible to further prolong the life of the cleaning blade 21.

[Modified Example 2]

(A. Configuration)

Figure 16A:
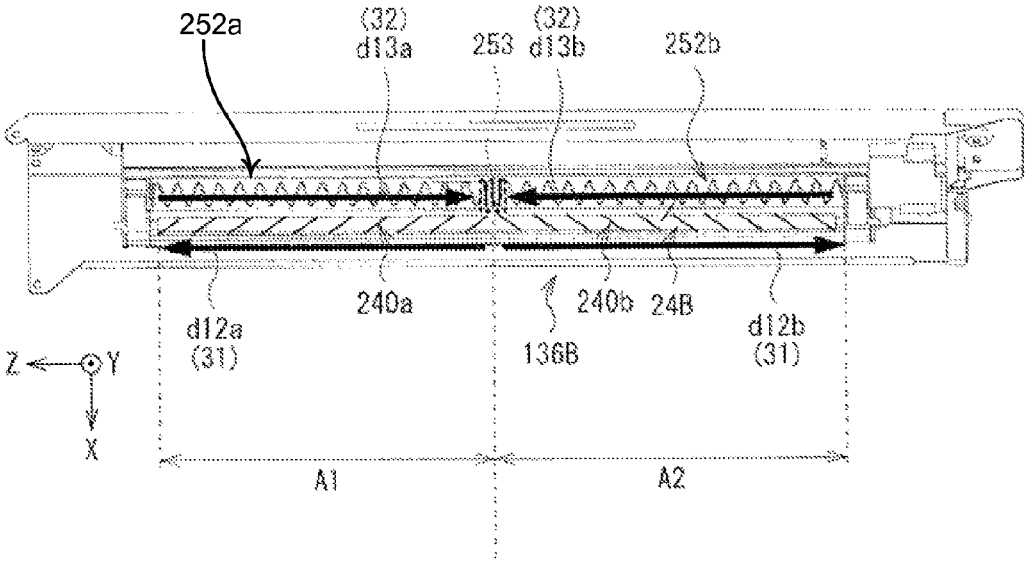
FIG. 16A and FIG. 16B show examples of the configurations of the main parts of the cleaning mechanism according to Modified Example 2.
Figure 16B:
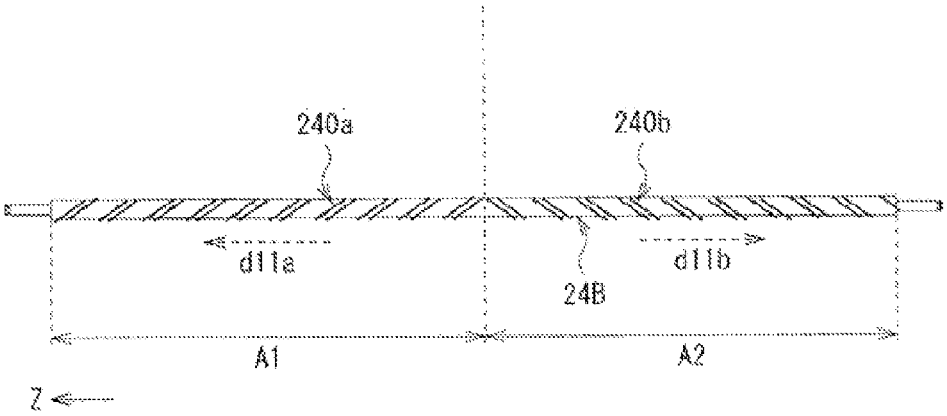

FIG. 16A and FIG. 16B show examples of the configurations of the main parts of the cleaning mechanism (cleaning mechanism 136B) according to Modified Example 2. Specifically, FIG. 16A shows a top view of an example of the structure of the outer appearance of the main part of the cleaning mechanism 136B. Further, FIG. 16B shows an example of the detailed structure of the later explained toner supply roller 24B as shown in FIG. 16A.

The cleaning mechanism 136B of this modified example, as shown in FIG. 16A and FIG. 16B, corresponds to the cleaning mechanism 136 described in the embodiment in the following manner. That is, it corresponds the example in which the toner supply roller 24B and the carrying spirals 252*a* and 252*b* explained hereinafter are provided in place of the toner supply roller 24 and the carrying spiral 252, and the position in which the toner ejection opening 253 is formed is changed, and the other configurations are the same.

In addition, the toner supply roller 24B corresponds to one specific example of the "supply member" or the "supply roller" of the present invention. Also, the carrying spiral 252*a* corresponds to one specific example of the "first structural body" of the present invention and the carrying spiral 252*b* corresponds to one specific example of the "second structural body" of the present invention.

The toner supply roller 24B, as shown in FIG. 16B, corresponds to the toner supply roller 24 in which a spiral-shaped ditch part 240*a* and 240*b* are formed in the same manner as the toner supply roller 24A of Modified Example 1. However, in the toner supply roller 24B, in contrast to the toner supply roller 24A, two regions A1 and A2 having different spiraling directions from each other are formed along the extending direction (Z-axis direction).

Specifically, as shown in FIG. 16B, in the region A1, the spiraling direction in the formed ditch part 240*a* is a direction d11*a* (+Z direction). On the other hand, in the region A2, the spiraling direction of the formed ditch part 240*b* is a direction d11*b* (−Z direction) which is a direction opposite to the direction d11*a* (opposite direction). In addition, each of these directions d11*a* and d11*b* respectively correspond to one specific example of the "first direction" and the "second direction" of the present invention. Also, the regions A1 and A2 respectively correspond to one specific example of the "first region" and the "second region" of the present invention.

The carrying spiral 252*b*, as shown in FIG. 16A, is arranged at a region facing the aforementioned region A1 and is a spiral-shaped structural body in the same manner as the carrying spiral 252. Also, the spiraling direction of the carrying spiral 252*b* is a direction d13*a* (−Z direction), which is the same direction as the aforementioned direction d11*b*.

On the other hand, the carrying spiral 252*b*, as shown in FIG. 16A, is arranged at a region facing the aforementioned region A2 and is a spiral-shaped structural body in the same manner as the carrying spiral 252. Also, the spiraling direction of the carrying spiral 252*b* is a direction d13*b* (+Z direction), which is the same direction as the aforementioned direction d11*a*. In the embodiment, the carrying spirals 252*a* and 252*b* are configured as a single unit, rotating together. The spiral formations to carry the remaining developer are opposite directions between the spiral 252*a* and spiral 252*b*. As shown in FIG. 16A, the spiral 252*a* at left carries the remaining developer from the left to the right, see negative Z direction. The spiral 252*b* at right carries the remaining developer from the right to the left, see positive Z direction. Thereby, the carried remaining developers are collected from the both sides to the center where the toner ejection opening 253 is disposed.

The toner ejection opening 253 in this modified example, as shown in FIG. 16A, is arranged in the region (near the aforementioned central region) between these carrying spirals 252*a* and 252*b*.

(C. Functions/Effects)

Because of such a structure, in the cleaning mechanism 136B of this modified example, for example, as shown by the arrows d12*a* and d12*b* in FIG. 16 A, the remaining toner 31 is carried by the toner supply roller 24B to each of the end portions (left side region and the right side region) from near the central region. Further, for example, as shown by the arrows (direction d13*a*, d13*b*) in FIG. 16B, the excess portions of the remaining toners 31 (excess toner 32) carried to the left side region and the right side region in such a way are respectively carried to near the central region by the carrying spirals 252*a* and 252*b*. Then, a portion of the excess toner 32 carried near the central region in such a manner is ejected to the outside from the toner ejection opening 253 arranged near the central region.

In this way, in the modified example, by making the arrangement structure of the ditch part 240*a* and 240*b* and the carrying spirals 252*a* and 252*b* in the toner supply roller 24B symmetrical, it becomes possible to further obtain the following effects in comparison to the aforementioned Modified Example 1. That is, the carrying distance of the remaining toner 31 and the excess toner 32 can be made shorter (about ½), and because of the aforementioned symmetrical arrangement structure, the unevenness of the toner amount in the longitudinal direction (Z-axis direction) can be further suppressed, and further uniformity can be achieved. Therefore, the toner can be further stably supplied to the surface of the intermediate transfer belt 131, and it becomes possible to further prolong the life of the cleaning blade 21.

In addition, the arrangement structure of the ditch part 240*a* and 240*b*, and the carrying spirals 252*a* and 252*b* in the toner supply roller 24B is not limited to the structure shown in FIG. 16A and FIG. 16B, respectively, and it can be other arrangement structures. Specifically, for example, their spiraling directions can be opposite from each other and the arrangement structure can be symmetrical.

[Modified Example 3]

Figure 17:
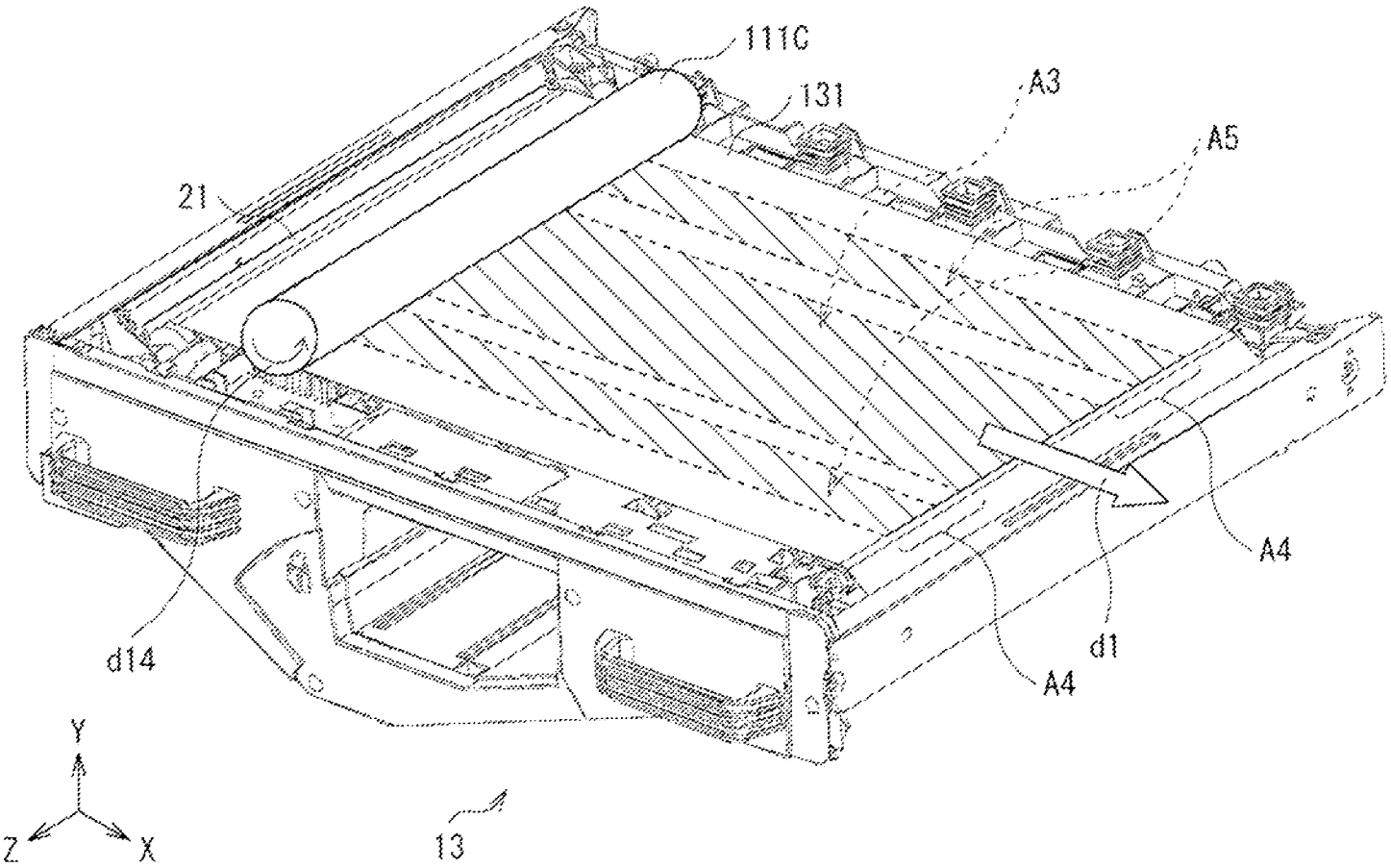
FIG. 17 is a perspective view showing an example of an outer appearance configuration of an intermediate transfer belt unit and a photosensitive drum according to Modified Example 3.

FIG. 17 shows a perspective view of an example of an outer appearance configuration of an intermediate transfer belt unit 13 and a photosensitive drum 111C according to Modified Example 3. The image forming apparatus of this modified example corresponds to the image forming apparatus 1 of the embodiment in which a photosensitive drum 111C explained below is provided in place of the photosensitive drum 111, and the other configurations are basically same.

The photosensitive drum 111C is further provided with the following functions in addition to the functions of the photosensitive drum 111 (function to supply toners to the transfer target region A3 among the surface of the intermediate transfer belt 131). That is, the photosensitive drum 111C is provided with a function for supplying a dummy toner to the non-transfer target region A4 among the surface of the intermediate transfer belt 131 in which the toner image (the original toner for forming images) is not carried. The dummy toner is a toner supplied actively to the cleaning mechanism 136 to be used as a lubricant agent. Further, in this example, the region in which such a dummy toner is supplied among the non-transfer target region A4 is shown as the dummy toner supply region A5.

Here, the photosensitive drum 111C corresponds to one specific example of the "dummy supply mechanism" of the present invention, and the aforementioned dummy toner corresponds to one specific example of the "dummy developer" of the present invention.

With such a configuration, in this modified example, for example, the following effects can be obtained in addition to the effects of the embodiment. That is, by supplying the dummy toner to the non-transfer target region A4 with the photosensitive drum 111C that rotates in a direction indicated by an arrow d14, the toner (dummy toner) can be actively supplied to the cleaning mechanism 136 without interfering with the original image forming (printing). Therefore, the amount of the toner functioning as a lubricant agent can be increased without especially adding exclusive members, etc., and even in a case of a strict condition (print pattern) in which an amount of the remaining toner 31 is hardly produced, the toner can be stably supplied to the surface of the intermediate transfer belt 131. Therefore, in this modified example, it is possible to further prolong the life of the cleaning blade 21.

Further, also in this modified example, the cleaning mechanisms 136A and 136B explained in Modified Example 1 and Modified Example 2 can be provided in place of the cleaning mechanism 136.

[Modified Example 4]

Figure 18:
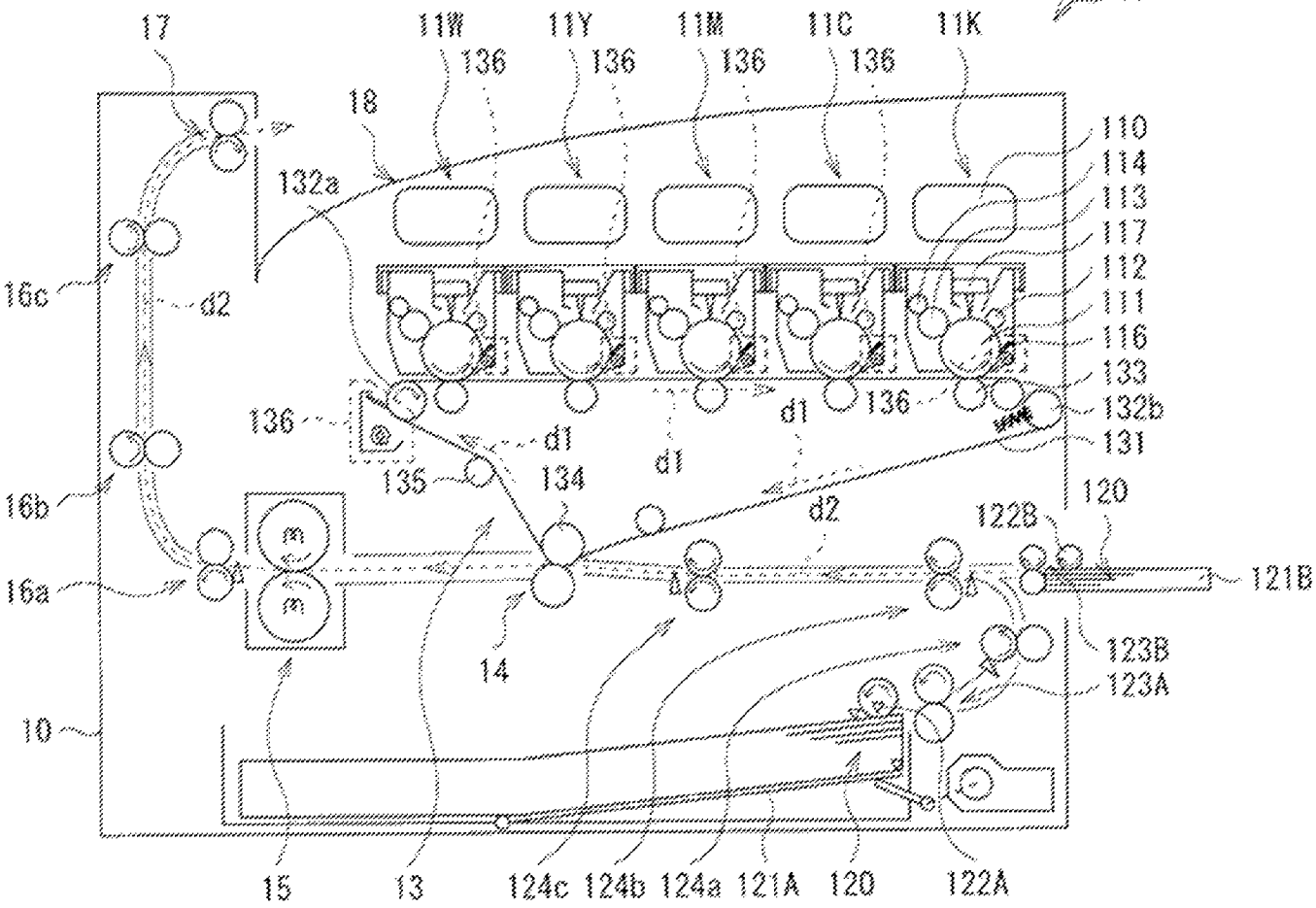
FIG. 18 is a schematic view showing an example of a schematic configuration of an image forming apparatus according to Modified Example 4.

FIG. 18 schematically shows an example of a schematic configuration of an image forming apparatus (image forming apparatus 1D) according to Modified Example 4. The image forming apparatus 1D of this modified example corresponds to the image forming apparatus 1 of the embodiment shown in FIG. 1 in which the cleaning mechanism 136 explained in the embodiment is also provided in each of the image forming parts 11W, 11Y, 11M, 11C, and 11K, and the other configurations are basically same.

That is, in each of the image forming parts 11W, 11Y, 11M, 11C, 11K, in addition to each of the members explained above, a photosensitive drum 111 for carrying a toner image of each color, a cleaning blade 116, a toner accumulation part 23, and a cleaning mechanism 136 including a toner supply roller 24 are further provided. Therefore, in this modified example, in addition to the intermediate transfer belt 131, the photosensitive drum 111 corresponds to one specific example of the "image carrier" in this present invention, and the cleaning blade 116 corresponds to one specific example of the "cleaning member" of the present invention in addition to the cleaning blade 21. Also, in this modified example, in addition to the intermediate transfer belt unit 13, the photosensitive drum 111 and a unit including the cleaning mechanism 136 including the cleaning blade 116 also correspond to one specific example of the "image carrier" in this present invention.

With such a configuration, in this modified example, for example, the following effects can be obtained in addition to the effects of the embodiment. That is, the remaining toner 31 accumulating in the toner accumulation part 23 can be stably supplied to the surface of the photosensitive drum 111 by the toner supply roller 24. Therefore, using the functions of the toner as a lubricant agent, abrasion or "turn-up" of the cleaning blade 116 can be prevented, and it becomes possible to prolong the life of the cleaning blade 116 in addition to the cleaning blade 21 with the toner supply roller 24.

Further, also in this modified example, the cleaning mechanisms 136A and 136B explained in Modified Example 1 and Modified Example 2 can be provided in place of the cleaning mechanism 136. Further, in this modified example, the photosensitive drum 111C explained in Modified Example 3 can be provided in place of the photosensitive drum 111.

[Modified Example 5]

Figure 19:
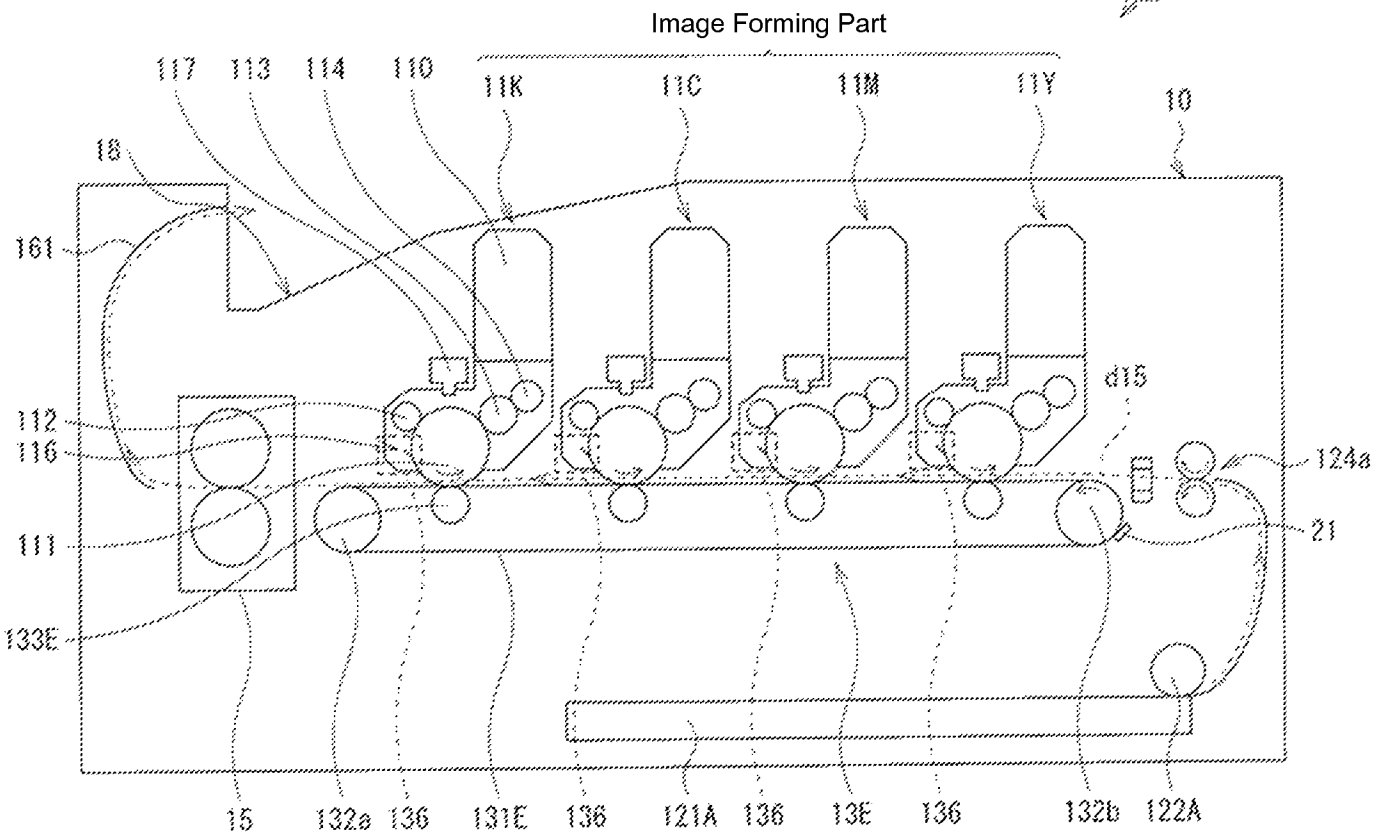
FIG. 19 is a schematic view showing an example of a schematic configuration of an image forming apparatus according to Modified Example 5.

FIG. 19 schematically shows an example of a schematic configuration of an image forming apparatus (image forming apparatus 1E) according to Modified Example 5. The image forming apparatus 1D of this modified example differs from the image forming apparatus 1, 1D, etc., as described above, and as described hereinafter, it is an image forming apparatus that directly transfers a toner image to a recording medium 120 without using the intermediate transfer belt unit 13, which is referred to as a direct transfer method.

That is, in the image forming apparatus 1E of this modified example, as shown in FIG. 19, a transfer belt unit 13E (direct transfer belt unit) for directly transferring the toner image of each color to the recording medium 120 in place of the intermediate transfer belt unit 13. The transfer belt unit 13E is constituted so as to include a transfer belt 131E and a transfer roller 133E for performing such a direct transfer, a drive roller 132*a* and an idler roller 132*b*, and a cleaning blade 21. The cleaning blade 21, in this modified example, is a member for scraping and removing the remaining toner remaining on the surface of the intermediate transfer belt 131E.

Further, in the example of this image forming apparatus 1E, the sheet tray 121B, the pickup roller 122B, the separation rollers 123A and 123B, and the carrying roller pairs 124*a*, 124*b*, and 124*c* are not provided. Further, a sheet guide 161 is provided in place of the carrying roller pairs 16*a*, 16*b*, and 16*c*. Furthermore, in place of five 11W, 11Y, 11M, 11C, and 11K, four image forming parts 11Y, 11M, 11C, and 11K are provided, and since it uses a direct transfer method instead of an intermediate transfer method, their arrangement order is changed (opposite). Further, the arrow d15 as shown in FIG. 19 shows a carrying direction (carrying path) of a recording medium 120.

Here, in the image forming apparatus 1E of this modified example, in each of the image forming parts 11Y, 11M, 11C, 11K, in addition to each of the members explained above, a photosensitive drum 111 for carrying toner images of each color, a cleaning blade 116, a toner accumulation part 23, and a cleaning mechanism 136 including a toner supply roller 24 are further provided. Therefore, in this modified example, the photosensitive drum 111 corresponds to one specific example of the "image carrier" in this present invention, and the cleaning blade 116 corresponds to one specific example of the "cleaning member" of the present invention. Also, in this modified example, the photosensitive drum 111 and a unit including the cleaning mechanism 136 including the cleaning blade 116 correspond to one specific example of the "image carrier" in this present invention.

With such a configuration, in this modified example, in addition to the effects of the embodiments, for example, the following effects can be obtained. That is, the remaining toner 31 accumulated in the toner accumulation part 23 can be stably supplied to the surface of the photosensitive drum 111 by the toner supply roller 24. Therefore, using the functions of the toner as a lubricant agent, abrasion or "turn-up" of the cleaning blade 116 can be prevented, and it becomes possible to prolong the life of the cleaning blade 116.

Further, also in this modified example, the cleaning mechanisms 136A and 136B explained in Modified Example 1 and Modified Example 2 can be provided in place of the cleaning mechanism 136. Further, in this modified example, the photosensitive drum 111C explained in Modified Example 3 can be provided in place of the photosensitive drum 111. Further, for the cleaning blade 21 of this modified example, a cleaning mechanism having the same configuration as the cleaning mechanism 136 including the aforementioned cleaning blade 116 can be applied.

<3. Other Modified Examples>

Although the present invention was explained above by exemplifying some embodiments and modified examples, the present invention is not limited to these embodiments, etc., and various modifications can be made.

For example, in the aforementioned embodiments, etc., the configuration (shape, arrangement, number, etc.) of each member in the image forming apparatus were specifically exemplified and explained, the configurations of each of those members are not limited to the explanation of the aforementioned embodiments, and can have other shapes, arrangements, and numbers, etc. Further, the values, size relations, etc., of various parameters explained in the aforementioned embodiment are not limited to those of the aforementioned embodiments, and it can be controlled to be other values or size relations.

Further, for example, in the aforementioned embodiment, etc., the configurational example of the cleaning mechanism was specifically exemplified and explained, but it is not limited to that, and can be other configurational examples. That is, for example, the excess toner carrying mechanism 25 does not need to be always provided. Further, even when an excess toner carrying mechanism 25 is provided, the shape, the arrangement, the number, etc., of the member can be something else.

Furthermore, in the aforementioned embodiment, etc., a case in which a plurality of image forming parts (five image forming parts 11W, 11Y, 11M, 11C, 11K or four image forming parts 11Y, 11M, 11C, 11K) were formed was exemplified and explained, but it is not limited to that. That is, the number of the image forming parts producing the toner images (image layer), the combinations of toner colors used for it, etc., can be arbitrarily set according to the use and purposes. Further, depending on the case, there can be only one image forming part and the toner image can be a monochrome (a single-color) image. That is, the image forming apparatus can be made to function as a monochromatic printer.

In addition, in the aforementioned embodiment, etc., a sheet (normal sheet) was exemplified and explained as one example of a recording medium, but the recording medium is not limited to that, and other mediums can be used. Specifically, for example, it can be a special sheet such as an OHP (OverHead Projector) sheet, a card, a postcard, a thick paper, (for example, having a weight of 250 g/m$^2$ or more), an envelope, a coated paper having a large thermal capacity, etc.

Further, in the aforementioned embodiment, etc., an image forming apparatus that functions as a printer was exemplified and explained as one specific example of the "image forming apparatus" of the present invention, but it is not limited to that. That is, for example, the present invention can be applied to an image forming apparatus that functions as, for example, a facsimile, a copier, a multifunction machine, etc.

What is claimed is:

1. An image forming apparatus, comprising:

an image carrier that holds a developer image on a surface of the image carrier;

a cleaning member that removes a remaining developer that remains on the surface of the image carrier after the developer image is transferred to a transfer target by contacting the surface of the image carrier;

an accumulation part that accumulates the remaining developer removed by the cleaning member;

a supply member that supplies the remaining developer accumulated in the accumulation part to the surface of the image carrier, and a carrying mechanism that carries an excess developer toward an outside, the excess developer being defined as an excess among the remaining developer accumulated in the accumulation part, wherein the carrying mechanism includes:

an excess developer carrying path that extends in a width direction of the image carrier, along which the excess developer is carried;

a carrying member that carries the excess developer along the excess developer carrying path; and an ejection opening that is disposed at an end of the excess developer carrying path so that the excess developer carried by the carrying member is ejected to an outside, the carrying mechanism is in contact with a bottom surface of the excess developer carrying path, the accumulation part has a recess portion of which an opening faces upward, the recess portion having a bottom point therein, and the bottom surface of the excess developer carrying path is positioned above the bottom point of the accumulation part with a height gap $\Delta Y$.

2. The image forming apparatus according to claim 1, wherein the excess developer is defined as the excess overflowing from the accumulation part.

3. The image forming apparatus according to claim 1, wherein the carrying member is a spiral-shaped structural body extending along the excess developer carrying path and is rotatably driven.

4. The image forming apparatus according to claim 1, further comprising:

a dummy supplying mechanism that supplies a dummy developer to a non-transfer target region, the non-transfer target region being among the surface of the image carrier and defined as a region where the developer image is not carried.

5. The image forming apparatus according to claim 1, wherein the supply member is a supply roller extending in the width direction of the image carrier.

6. The image forming apparatus according to claim 5, wherein a spiral-shaped ditch part is formed on a surface of the supply roller.

7. The image forming apparatus according to claim 5, wherein the supply roller is rotatably biased by the image carrier.

8. The image forming apparatus according to claim 5, wherein a surface of the supply roller is made of an elastic body.

9. The image forming apparatus according to claim 5, wherein the accumulation part is arranged vertically below a contact portion where a tip of the cleaning member contacts the image carrier.

10. The image forming apparatus according to claim 5, wherein a developer is accumulated in the accumulation part before the image forming apparatus starts its first print.

11. The image forming apparatus according to claim 5, further comprising one or a plurality of image forming parts that form the developer image, wherein the image carrier is an intermediate transfer belt in which the developer image is primarily transferred to the surface from the image forming part, and the transfer target is a recording medium to which the developer image on the surface of the intermediate transfer belt is secondarily transferred.

12. The image forming apparatus according to claim 5, wherein the image forming part is further provided with a photosensitive drum as the image carrier, the cleaning member, the accumulation part, and the supply member inside the image forming part.

13. The image forming apparatus according to claim 5, wherein the photosensitive drum as the image carrier is provided in one or a plurality of image forming parts for forming the developer image, and the transfer target is a recording medium to which the developer image on the surface of the photosensitive drum is directly transferred.

14. An image forming apparatus, comprising:

an image carrier that holds a developer image on a surface of the image carrier;

a cleaning member that removes a remaining developer that remains on the surface of the image carrier after the developer image is transferred to a transfer target by contacting the surface of the image carrier;

an accumulation part that accumulates the remaining developer removed by the cleaning member;

a supply member that supplies the remaining developer accumulated in the accumulation part to the surface of the image carrier; and a carrying mechanism that carries an excess developer toward an outside, the excess developer being defined as an excess among the remaining developer accumulated in the accumulation part, wherein the carrying mechanism includes:

an excess developer carrying path that extends in a width direction of the image carrier, along which the excess developer is carried;

a carrying member that carries the excess developer along the excess developer carrying path; and an ejection opening that is disposed at an end of the excess developer carrying path so that the excess developer carried by the carrying member is ejected to an outside, the carrying member is a spiral-shaped structural body extending along the excess developer carrying path and is rotatably driven, the supply member is a rotatable supply roller extending in a width direction of the image carrier and provided with a spiral-shaped ditch part on a surface of the supply member, the supply roller includes, in the width direction of the image carrier, a first region in which a spiraling direction of the ditch part is a first direction, and a second region in which a spiraling direction of the ditch part is a second direction which is a direction opposite to the first direction, and the spiral-shaped structural body comprises:

a first structural body arranged in a region facing the first region, wherein the spiraling direction is the second direction; and a second structural body arranged in a region facing the second region, wherein the spiraling direction is the first direction.

15. The image forming apparatus according to claim 14, wherein the first direction in the first region and the second direction in the second region are each a direction toward each end part of the supply roller from near a central region, and the ejection opening is formed in a region between the first structural body and the second structural body.

16. An image forming apparatus, comprising:

an image carrier that holds a developer image on a surface of the image carrier;

a cleaning member that removes a remaining developer that remains on the image carrier after the developer image is transferred to a transfer target by contacting the surface of the image carrier;

an accumulation part that accumulates the remaining developer removed by the cleaning member;

a supply member that supplies the remaining developer accumulated in the accumulation part to the surface of the image carrier; and a carrying mechanism that carries the remaining developer accumulated in the accumulation part, wherein the carrying mechanism includes:

a carrying path along which the remaining developer is carried, a carrying member that carries the remaining developer along the carrying path, and an ejection opening that ejects the remaining developer carried along the carrying path, and a rotational axis of the carrying member is positioned higher in a gravitational direction than a rotational axis of the supply member.

17. The image forming apparatus according to claim 16, further comprising:

an image carrier roller that contacts and rotates with the image carrier, wherein the supply member is rotated by movement of the image carrier, and the supply member is positioned directly across from the image carrier roller via the image carrier.

18. The image forming apparatus according to claim 16, wherein the carrying mechanism is in contact with a bottom surface of the carrying path, the accumulation part has a recess portion of which an opening faces upward, the recess portion having a bottom point therein, and the bottom surface of the carrying path is positioned above the bottom point of the accumulation part with a height gap $\Delta Y$.

19. The image forming apparatus according to claim 16, wherein the carrying member is a spiral-shaped structural body extending along the carrying path and is rotatably driven.

20. The image forming apparatus according to claim 16, further comprising:

a dummy supplying mechanism that supplies a dummy developer to a non-transfer target region, the non-transfer target region being among the surface of the image carrier and defined as a region where the developer image is not carried.

21. The image forming apparatus according to claim 20, wherein the supply member is a rotatable supply roller extending in a width direction of the image carrier and provided with a spiral-shaped ditch part on a surface of the supply member, the supply roller includes, in the width direction of the image carrier, a first region in which a spiraling direction of the ditch part is a first direction, and a second region in which a spiraling direction of the ditch part is a second direction which is a direction opposite to the first direction; and the spiral-shaped structural body comprises:

a first structural body arranged in a region facing the first region, wherein the spiraling direction is the second direction; and a second structural body arranged in a region facing the second region, wherein the spiraling direction is the first direction.

22. The image forming apparatus according to claim 21, wherein the first direction in the first region and the second direction in the second region are each a direction toward each end part of the supply roller from near a central region, and the ejection opening is formed in a region between the first structural body and the second structural body.

23. The image forming apparatus according to claim 16, wherein a developer is accumulated in the accumulation part before the image forming apparatus starts its first print.

24. The image forming apparatus according to claim 16, further comprising one or a plurality of image forming parts that form the developer image, wherein the image carrier is an intermediate transfer belt in which the developer image is primarily transferred to the surface from the image forming part, and the transfer target is a recording medium to which the developer image on the surface of the intermediate transfer belt is secondarily transferred.

25. The image forming apparatus according to claim 16, wherein the image forming part is further provided with a photosensitive drum as the image carrier, the cleaning member, the accumulation part, and the supply member inside the image forming part.

26. The image forming apparatus according to claim 16, wherein the photosensitive drum as the image carrier is provided in one or a plurality of image forming parts for forming the developer image, and the transfer target is a recording medium to which the developer image on the surface of the photosensitive drum is directly transferred.

* * * * *